US009546845B2

(12) United States Patent
Mather

(10) Patent No.: US 9,546,845 B2
(45) Date of Patent: Jan. 17, 2017

(54) FIREARM WITH FOLDING BUTTSTOCK

(71) Applicant: Sturm, Ruger & Company, Inc., Southport, CT (US)

(72) Inventor: Jonathan Philip Mather, Grafton, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/925,370

(22) Filed: Oct. 28, 2015

(65) Prior Publication Data

US 2016/0116250 A1 Apr. 28, 2016

Related U.S. Application Data

(60) Provisional application No. 62/069,725, filed on Oct. 28, 2014.

(51) Int. Cl.
*F41C 23/04* (2006.01)
*F41A 3/66* (2006.01)

(52) U.S. Cl.
CPC *F41C 23/04* (2013.01); *F41A 3/66* (2013.01)

(58) Field of Classification Search
CPC ..... F41C 23/04; F41A 3/66
USPC ..... 42/71.01, 71.302, 72, 73, 74, 75.01, 42/75.3, 75.1
See application file for complete search history.

(56) References Cited

U.S. PATENT DOCUMENTS 543,138 A * 7/1895 Murray ..... F41C 23/04 42/71.01
3,369,316 A 2/1968 Miller
4,780,929 A 11/1988 Burns et al.
7,673,412 B2 3/2010 Griffin
7,802,392 B2 9/2010 Peterson et al.
7,827,721 B2 11/2010 Griffin
7,966,761 B1 6/2011 Kuczynko et al.
8,203,058 B2 6/2012 Leach
8,312,661 B2 11/2012 Ludlow
(Continued)

FOREIGN PATENT DOCUMENTS

CN 201748859 2/2011
DE 102006047959 6/2008
(Continued)

OTHER PUBLICATIONS

Corresponding International Search Report and Written Opinion for PCT/US15/57808 dated Jan. 20, 2016.

*Primary Examiner* — Bret Hayes
(74) *Attorney, Agent, or Firm* — The Belles Group, P.C.

(57) ABSTRACT

A firearm includes a receiver, barrel coupled to the receiver, and buttstock. An openable/closeable hinge assembly comprising front and rear hinge elements pivotably mounts the buttstock to the receiver. A latch mechanism carried by the hinge assembly includes a latch pin having latch and lock members on opposing ends. The pin is both slidable and rotatable in the hinge assembly. When the buttstock is in an unfolded position in axial alignment with the barrel axis, the latch member engages a latch recess on a first lateral side of the hinge assembly to latch the buttstock in position. The buttstock may be pivoted laterally outwards about the hinge assembly to a folded position offset from the barrel centerline. Rotating the latch member engages the lock member with a lock recess on the hinge assembly to lock the buttstock in the folded position.

20 Claims, 19 Drawing Sheets

(56) References Cited

U.S. PATENT DOCUMENTS

| | | | | |
|---|---|---|---|---|
| 8,464,458 | B2 | 6/2013 | Chvala | |
| 8,631,601 | B2 | 1/2014 | Langevin et al. | |
| 8,769,855 | B2 | 7/2014 | Law | |
| 2003/0051385 | A1* | 3/2003 | Wygant | F41C 23/04 42/72 |
| 2009/0277066 | A1* | 11/2009 | Burt | F41A 3/66 42/6 |
| 2010/0307042 | A1* | 12/2010 | Jarboe | F41A 3/18 42/6 |
| 2012/0079752 | A1* | 4/2012 | Peterson | F41A 11/02 42/75.02 |
| 2012/0137561 | A1 | 6/2012 | Ludlow | |
| 2012/0144712 | A1 | 6/2012 | Rostocil | |
| 2013/0212920 | A1 | 8/2013 | Law | |
| 2014/0196345 | A1* | 7/2014 | Grimshaw | F41C 23/04 42/73 |
| 2014/0196346 | A1* | 7/2014 | Grimshaw | F41C 23/04 42/73 |
| 2015/0176945 | A1* | 6/2015 | Simek | F41A 3/64 42/75.03 |

FOREIGN PATENT DOCUMENTS

| | | |
|---|---|---|
| RU | 2077016 | 4/1997 |
| WO | 2009046456 | 4/2009 |

* cited by examiner

FIREARM WITH FOLDING BUTTSTOCK

CROSS-REFERENCE TO RELATED APPLICATIONS

The present application claims the benefit of priority to U.S. Provisional Application No. 62/069,725 filed Oct. 28, 2014, the entirety of which is incorporated herein by reference.

BACKGROUND

The present invention generally relates to firearms, and more particularly to a folding buttstock mechanism for a firearm that provides a means of securing the stock in the folded position using the same components that secure the stock in the straight inline position.

Folding stocks on rifles, particularly rifles with longer barrels, allow the user to transport or store the firearm more conveniently and in a smaller container. In addition, on some rifles with the buttstock mounted directly behind the receiver, the folding motion is necessary to allow removal of the bolt or other internal components and to allow the firearm to be cleaned from the breech end. Folding stock mechanisms are generally designed to lock in a position in-line with the barrel and action for conventional shoulder mounted operation. Some folding mechanisms also provide a means of locking the buttstock in the folded position to prevent accidental or unwanted movement which might cause inconvenience, noise or possible injury if pinched. Some provide a solid mechanical lock while others a resistive/detent type retention that is overcome by force. Many of these locks or restraints consists of features on the side of the butt stock and the side of the firearm receiver, forward stock, or chassis sidewalls. Some bolt action rifles use the bolt knob to provide the detent surface.

There are several problems with the designs described above. Because most locking/retention features are located on the butt stock and center portion of the rifle, the butt stock cannot be changed without eliminating this feature, or very few compatible stocks are available. In the case of the bolt knob detent design, the bolt knob and the butt stock cannot be changed because they must fit closely together to provide full folding motion and retention. On rifles with many available butt stock options, like AR-15's, it is not practical to have a locking feature on the butt stock.

Other locking configurations automatically lock when folded. In some instances this is desirable; in other cases the release mechanism is not intuitive or causes inconvenience when the operator did not intend to lock the butt stock. A separate locking mechanism for the folded position also adds addition components and cost to the assembly. Yet other designs have no locking capability at all, and while some of these have intentionally dampened rotation, they are still prone to swinging back and forth and relocking when undesired.

Accordingly, an improved folding buttstock design is desired which can conveniently be secured in both the inline unfolded and folded positions.

SUMMARY

A folding buttstock for a firearm is provided which overcomes the foregoing shortfalls of present folding buttstock design. The folding buttstock includes a unique latching mechanism which advantageously functions to both securely latch the buttstock in an unfolded inline position for discharging the firearm, and lock the buttstock in a folded offset position without any additional components. This allows transport and storage of the firearm in a compact form. In one embodiment, the latching mechanism includes a latch pin which is both slidably and rotatably disposed in a hinge assembly to achieve this functionality. The latch pin includes a latch member on one end and a lock member on the other end, each of which is selectively engageable with a mating recess formed in opposing sides of the hinge assembly, as further described herein. Advantageously, because the latching and locking features are both integrated into the hinge assembly itself which movably couples the buttstock to the receiver, a self-locking buttstock hinge is formed thereby allowing a wide range of different firearms and types of buttstock to be used with the hinge assembly for creating the foldable buttstock arrangement without regard for the configuration of the receiver or buttstock to achieve the latching and locking functions. In one non-limiting embodiment, the hinge assembly may be configured to mount on the receiver of a bolt action rifle and accommodate most buttstocks compatible with AR-15/AR-10 type rifle interfaces. XXS CHANGED claim 1

According to one aspect of the invention, a firearm with folding buttstock includes: a receiver; a barrel coupled to a front end of the receiver, the barrel defining a longitudinal axis and an axially extending bore forming a projectile pathway; an elongated buttstock defining a stock axis; a hinge assembly pivotably coupling the buttstock to the receiver, the hinge assembly comprising a fixed front hinge element coupled to the receiver, a movable rear hinge element coupled to the buttstock, and a hinge pivotably coupling the front and rear hinge elements together; the buttstock pivotably movable between an inline position, and an offset position in which the stock axis is laterally offset from the longitudinal axis; a latch pin rotatably and slideably carried transversely by the hinge assembly; a latching mechanism on a first lateral side of the hinge assembly comprising a latch member on a first end of the latch pin engageable with a latch recess on the first lateral side, the latching mechanism operable to maintain the buttstock in the inline position when the latch member engages the latch recess; a locking mechanism on a second lateral side of the hinge assembly comprising a lock member on a second end of the latch pin engaging a lock recess on the second lateral side, the locking member operable to maintain the buttstock in the offset position when the lock member engages the lock recess; and a latch spring biasing the latch member in an inward direction and the lock member in an outward direction with respect to the hinge assembly; wherein rotating the latch member in opposing directions selectively engages the lock member with or disengages the lock member from the lock recess when the buttstock is in the offset position.

According to another aspect, a self-locking pivotable buttstock hinge assembly for a firearm having a receiver and a buttstock is provided. The hinge assembly includes: a front hinge element configured for attachment to the receiver of the firearm, the front hinge element defining a longitudinal axis and comprising a first lateral side, a second lateral side and a plurality of knuckles each including a through hole collectively defining a pivot axis; a rear hinge element comprising a first lateral side, a second lateral side, a plurality of knuckles pivotably connected to the knuckles of the first element by a hinge pin, the rear hinge element movable between a closed position and an open position, the rear hinge element defining a mounting flange configured for attachment of the buttstock; a latch pin extending through a transverse passage formed between the first and second lateral sides front or rear hinge element, the latch pin being slidable and rotatable in the passage; a latch recess formed in the first lateral side of the front or rear hinge element which does not have the latch pin; a lock recess formed in the second lateral side of the front or rear hinge element which does not have the latch pin; an elongated latch having an inwardly projecting latching protrusion on one end of the latch pin; an elongated release button on another end of the latch pin having a locking element; and a latch spring biasing the latch in an inward direction and the release button in an outward direction with respect to the front or rear hinge element which does not have the latch pin; wherein when the rear hinge element is in the closed position, the latching protrusion engages the latch recess and latches the rear hinge element in the closed position; and wherein when the rear hinge element is in the open position, the locking element is rotatable by rotating the latch to engage the locking element with the lock recess and locks the rear hinge element in the open position.

A method for operating a folding firearm buttstock is provided. The method includes: providing a firearm including a receiver, a barrel supported by the receiver, a buttstock, and a hinge assembly comprising a front hinge element fixedly attached to the receiver, a rear hinge element pivotably attached to the front hinge element, and a spring-biased latch pin carried by the hinge assembly comprising an elongated latch member disposed on a first end of the latch pin and an elongated lock member disposed on a second end of the latch pin, the buttstock attached to the rear hinge element and movable therewith; placing the latch member in a horizontal orientation; engaging the latch member with a latch recess on a first lateral side of the hinge assembly, wherein the buttstock is in a latched inline position with respect to the barrel; disengaging the latch member from the latch recess by pushing the lock member towards the first lateral side of the hinge assembly; pivoting the buttstock laterally outwards about the hinge assembly in a first direction; contacting the lock member with a second lateral side of the hinge assembly opposite the first lateral side; rotating the latch member to a vertical orientation while maintaining contact with the second lateral side of the hinge assembly; and engaging the lock member with a lock recess on the second lateral side of the hinge assembly, wherein the buttstock is in a locked offset position laterally offset from and parallel to the barrel.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which:

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures. Furthermore, a general reference to a whole figure number (e.g. FIG. 6) which may include multiple subparts (e.g. FIGS. 6A, 6B, etc.) shall be construed as a reference to all of the subparts unless specifically noted otherwise.

DETAILED DESCRIPTION

Figure 1:
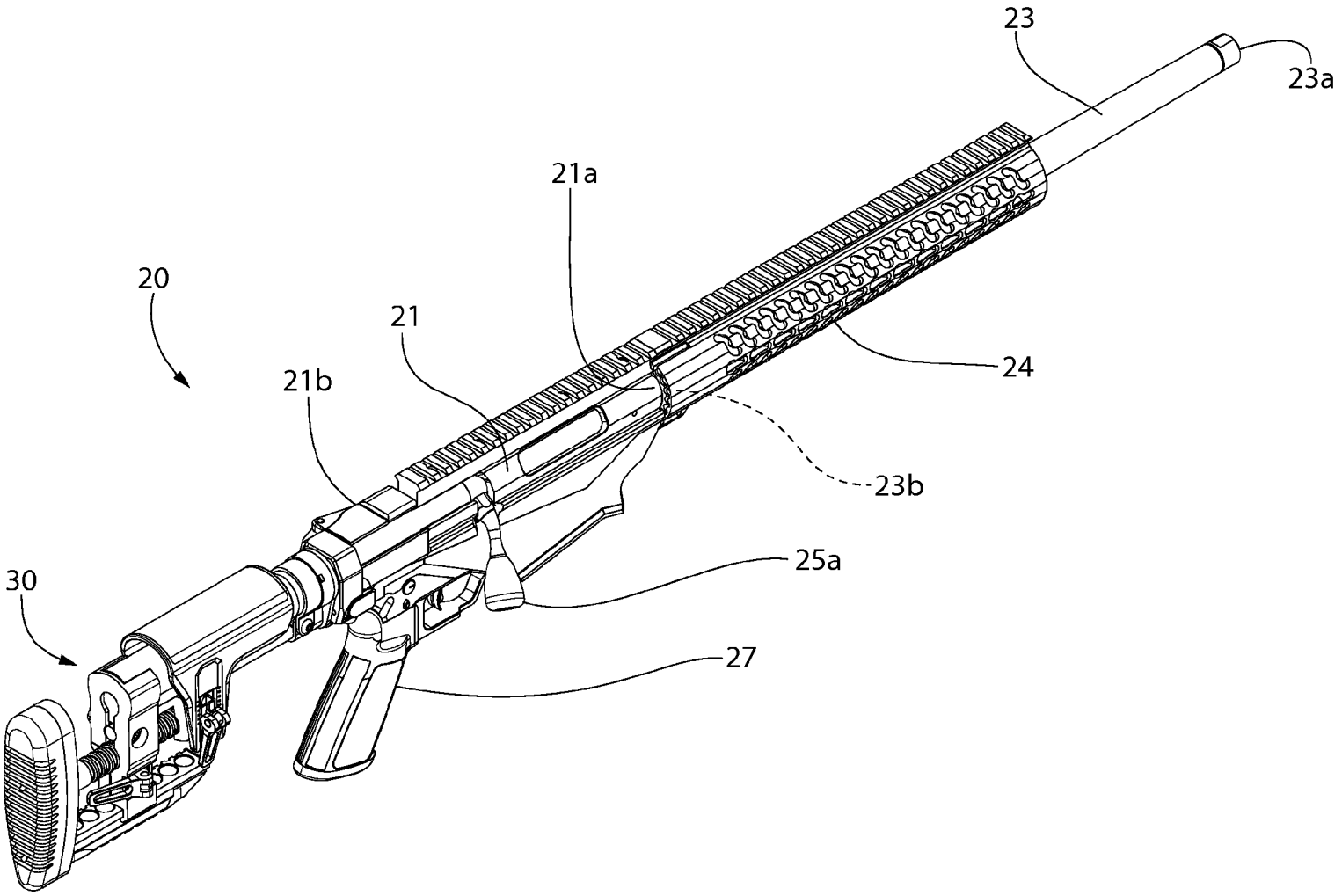
FIG. 1 is a longitudinal perspective view of one embodiment of a firearm including a foldable buttstock with latching and locking mechanisms according to the present disclosure.
Figure 2:
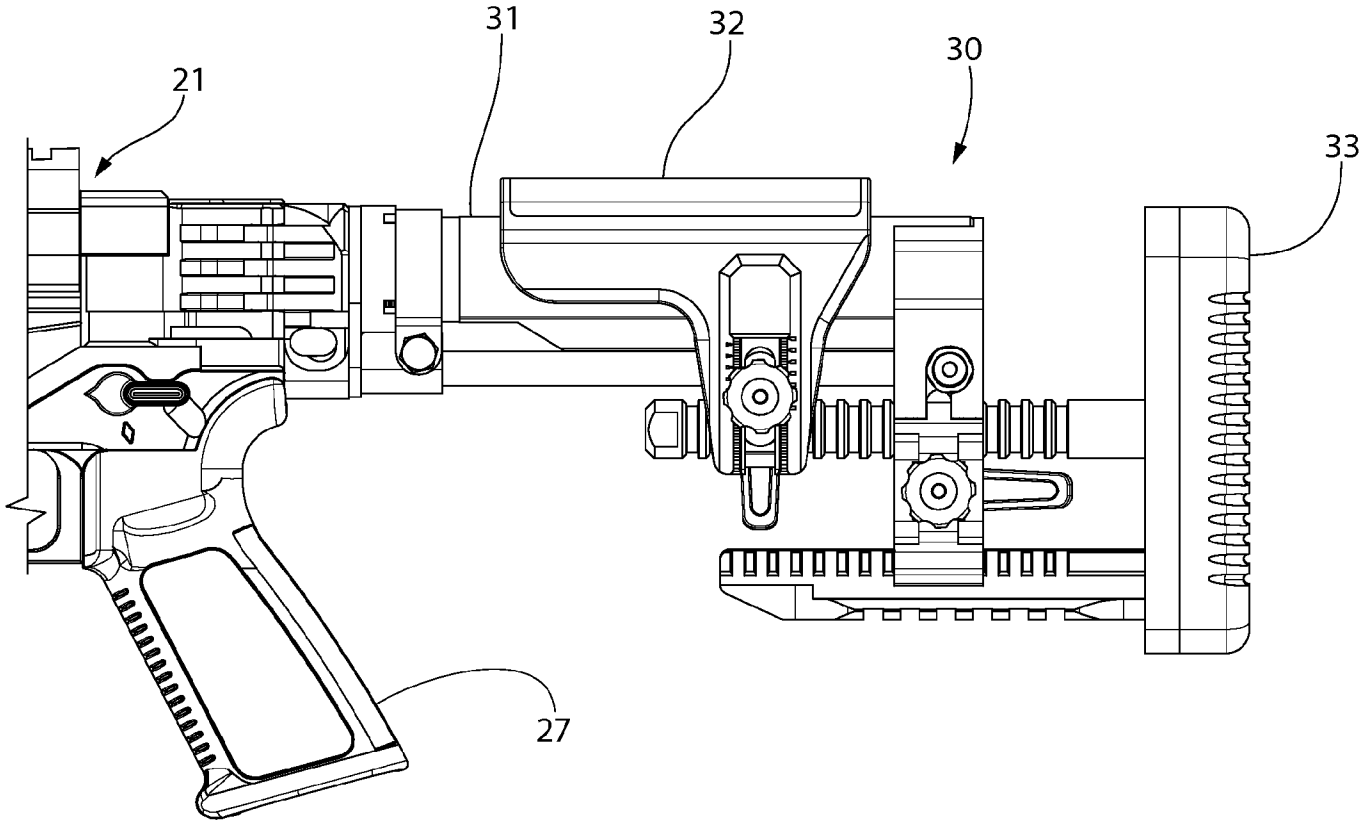
FIG. 2 is a partial left side view of the buttstock.
Figure 3:
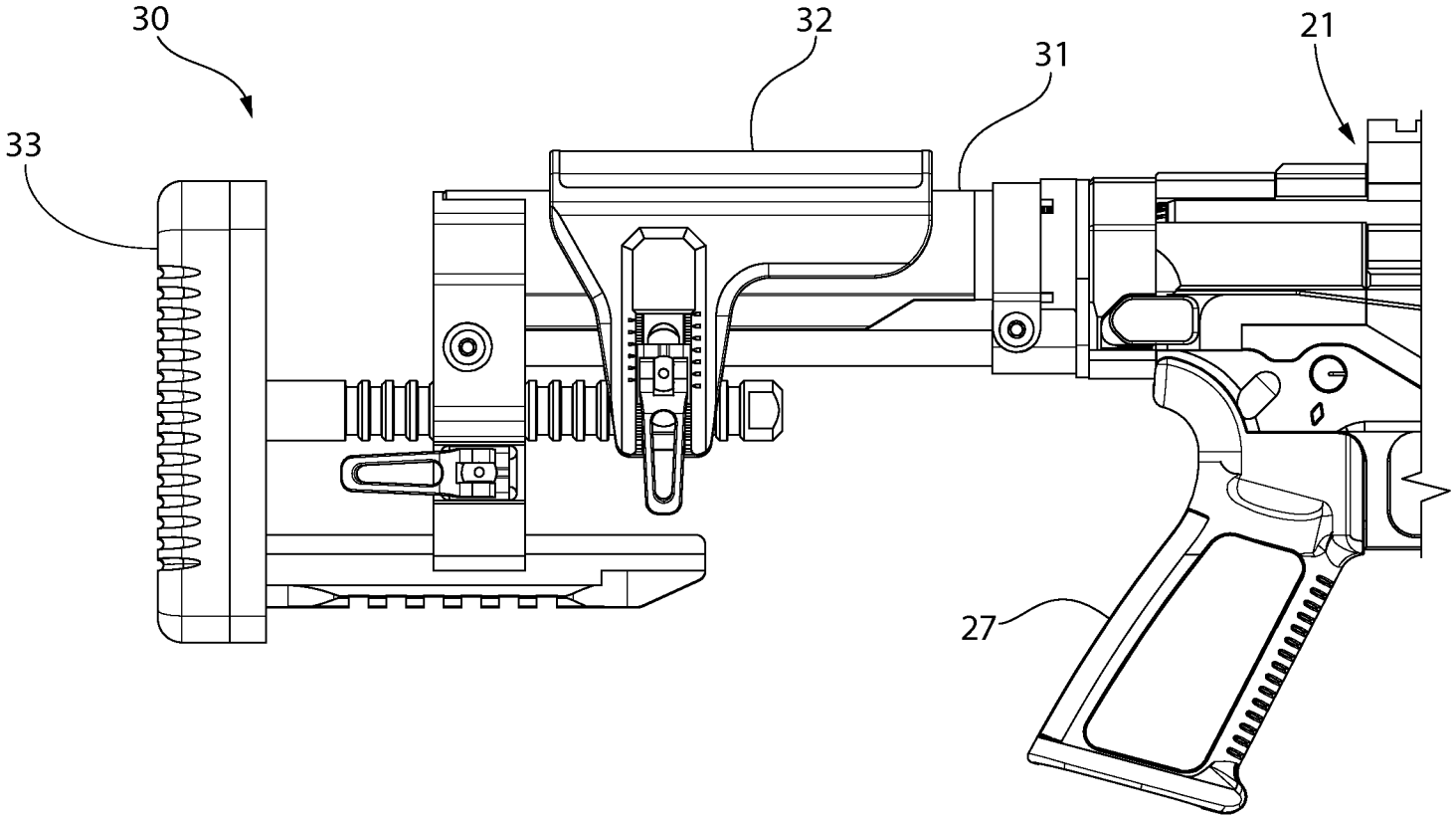
FIG. 3 is a partial right side view of the buttstock.
Figure 4:
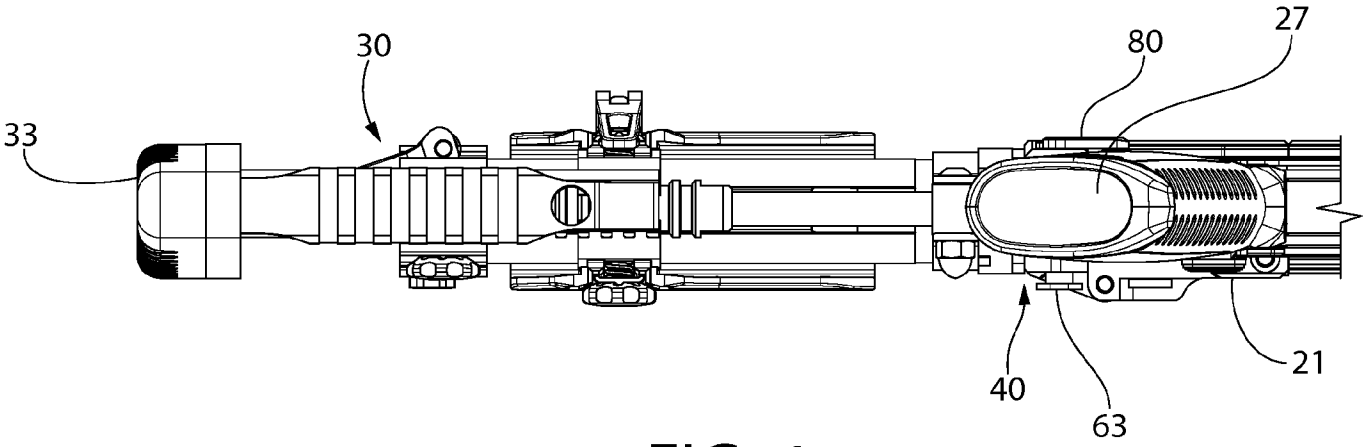
FIG. 4 is a bottom view thereof.
Figure 5:
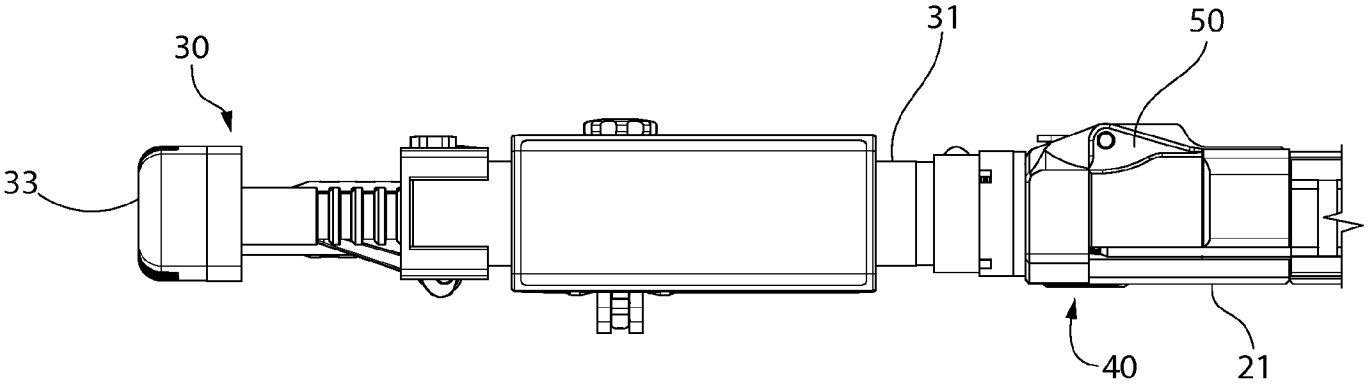
FIG. 5 is a top view thereof.
Figure 6A:
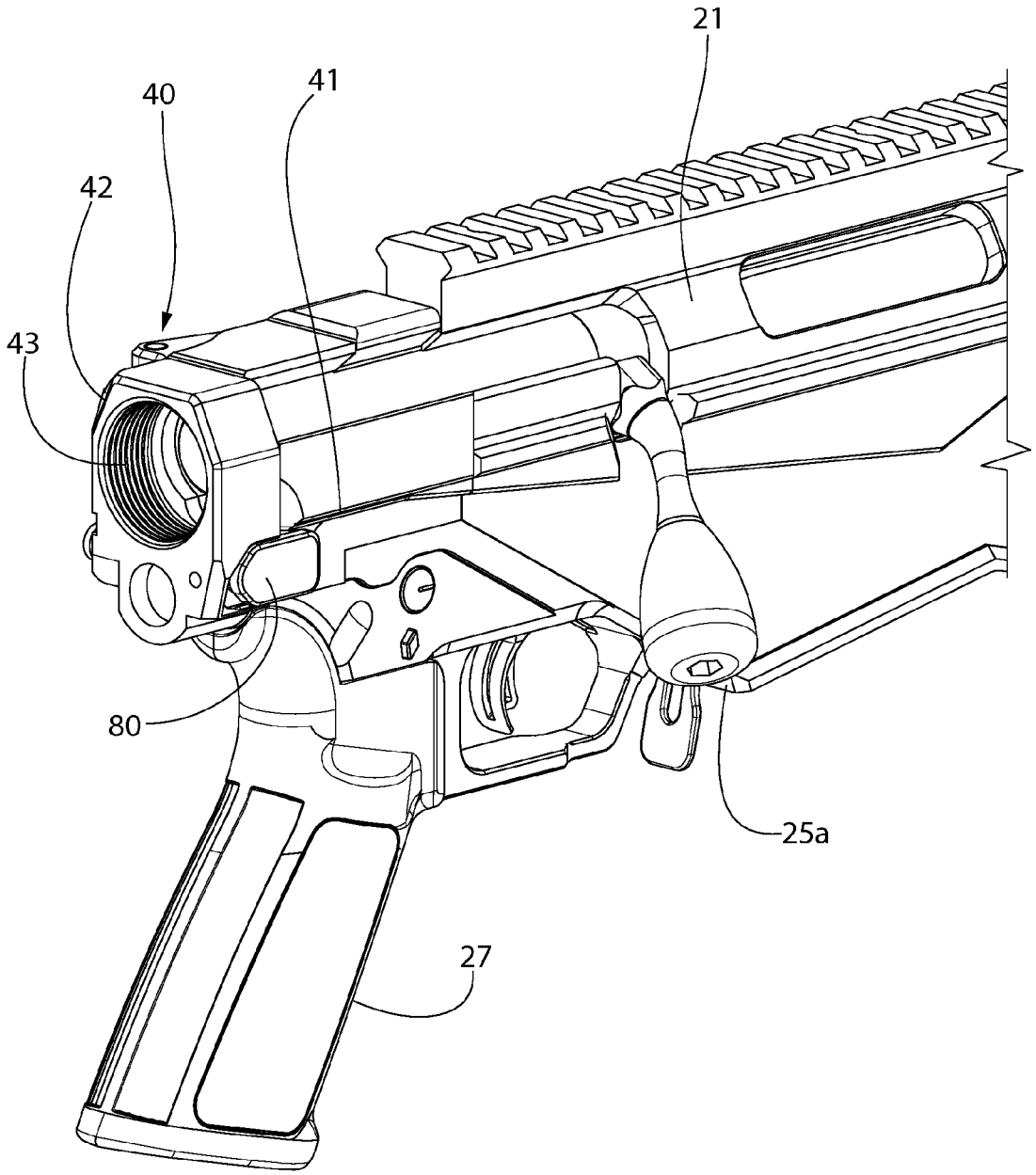
FIG. 6A is a right side perspective view thereof.
Figure 6B:
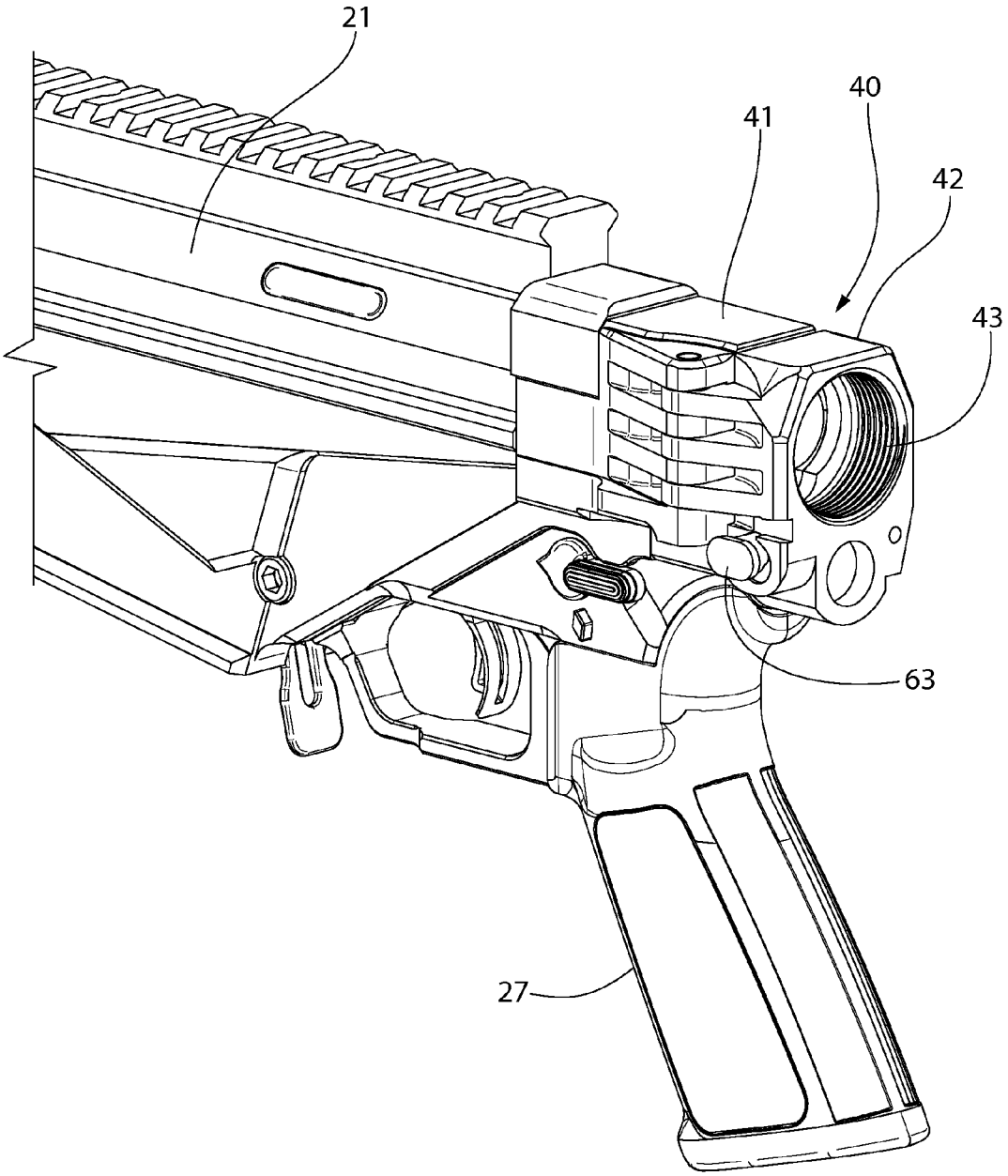
FIG. 6B is a left side perspective view thereof.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

FIG. 1 is a longitudinal perspective view of a firearm 20 having a folding buttstock system according to the present disclosure. Referring to FIGS. 1-6 and 12-13, firearm 20 generally includes a receiver 21, a trigger actuated fire control assembly 22 mounted in the receiver and operable to discharge the firearm, a barrel 23 supported by the receiver, and optionally a handguard 24 enclosing and circumscribing at least part of the length of the barrel. The barrel includes an open front muzzle end 23*a* and an open rear breech end 23*b* (obscured beneath the handguard) coupled to a front end 21*a* of the receiver 21 in any suitable manner. Handguard 24 may similarly be coupled to a front end of the receiver.

The receiver 21 may support other appurtenances including for example a handgrip 27 disposed on the bottom rear end 21*b* of the receiver and an axially movable bolt 25 which may include a bolt handle 25*a* for forming a closed or open breech. The bolt 25 is slidably moveable forward/rearward in an axially extending internal cavity of receiver 21 and includes a firing pin 26 for detonating a chambered cartridge in the rear breech end 23*b* of the barrel 23 that defines the chamber all of which is well understood by those skilled in the art without further elaboration.

The firearm 20 defines a longitudinal axis LA and axial direction coinciding with the centerline of the barrel 23 and its longitudinal bore formed therein between the muzzle and breech ends 23*a*, 23*b* (not shown) that defines a projectile pathway in a known manner. Firearm 20 may be any type of long gun, including without limitation a rifle or a shotgun. In one non-limiting example, the firearm 20 may be a bolt action rifle.

Firearm 20 further includes a buttstock 30 extending rearward from the receiver 21 for placement against the user's shoulder when aiming the firearm held in a ready-to-fire position to acquire a target. Buttstock 30 may be any type or configuration of buttstock including adjustable and non-adjustable varieties. The invention is not limited to the type of buttstock which may be used.

Referring to FIGS. 1-5 and 13-14, buttstock 30 in one non-limiting example may be an adjustable type buttstock having a standard AR-15 rifle style buffer tube 31 for coupling to the rear end of the receiver 21. Buttstock 30 may include a vertically adjustable cheek rest 32 and a horizontally/axially adjustable butt pad 33 allowing the length of the buttstock to be adjusted to accommodate different users. Buttstock 30 may be made of any variety of suitable materials including polymers, metals, composite materials, fiberglass, wood, and combinations thereof as some non-limiting examples.

To pivotably mount the buttstock 30 to the receiver 21 for providing a folding buttstock feature, a pivot coupling in the form of a hinge assembly 40 is provided. Referring to FIGS. 6-12, hinge assembly 40 includes a fixed front hinge element 41 and a movable rear hinge element 42 which are pivotably joined together by a hinge pin 52. The front hinge element 41 includes front face 41*d* forming an interface with the rear end 21*b* of receiver 21, rear face 41*c* defining an abutment surface for mating with the rear hinge element 42, a left lateral side 41*a*, and a right lateral side 41*b* (best shown in FIGS. 7A & B). Various appurtenances may be provided with the front hinge element to create a final mount that interfaces neatly with the configuration of the receiver 21 to which the element is attached. For example, in some embodiments a detachable cover 41*e* may be provided to enclose any gaps between the front hinge element 41 and the receiver (see, e.g. FIGS. 6B, 8A, and 8B) thereby providing an aesthetically pleasing and smooth transition of the hinge assembly 40 with receiver.

Front hinge element 41 is configured and adapted for rigid attachment to the rear end 21*b* of receiver 21, thereby defining the fixed or stationary part of the buttstock mount. The front hinge element 41 may securely fastened to the receiver 21 by any suitable means or combination of means including fasteners, pins, adhesives, welding, interference fits, etc. In one embodiment, fasteners are used. Preferably, the front hinge element 41 is removably secured to the receiver to allow replacement of the hinge assembly 40 if desired.

Figure 7A:
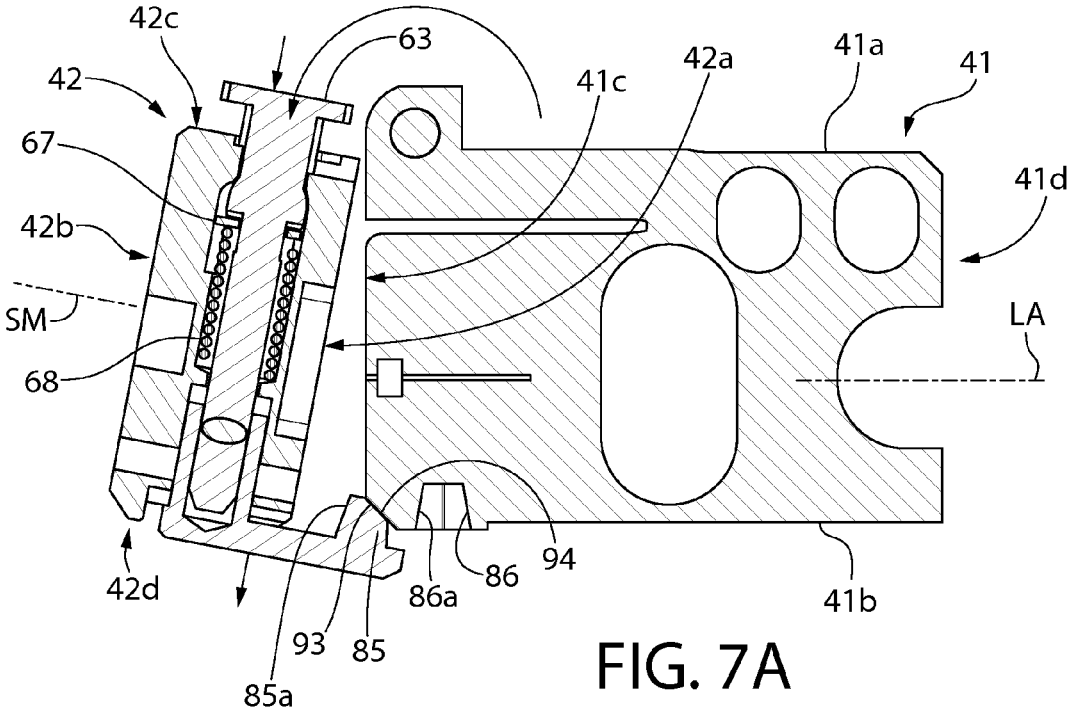
FIG. 7A is a cross-sectional top view of the openable/closeable hinge assembly of FIG. 1 showing the latching mechanism which also serves as the locking mechanism for the buttstock; the rear hinge element is rotated in a fully closed latched position.

The rear hinge element 42 includes front face 42*a* forming an interface with rear face 41*c* of front hinge element 41, rear face 42*b*, a left lateral side 42*c*, and a right lateral side 42*d* (best shown in FIGS. 7A & B). Rear hinge element 42 is configured for coupling the buttstock 30 to the firearm, thereby defining the movable part of the buttstock mount. The rear hinge element 42 defines a stock mounting axis SM which may remain parallel with the stock axis SA in some embodiments when the buttstock 30 is mounted to the rear hinge element. A rearwardly open internally threaded bore 43 is formed in the rear face 42*b* of rear hinge element 42 which is configured for threadable attachment to the externally threaded front end of the buffer tube 31 on the buttstock 30. An anti-rotation socket 91 may optionally be provided which receives a forwardly extending anti-rotation protrusion 92 on the front of the buttstock 30 (see, e.g. FIGS. 11A and 12, thereby forming a standard AR-15 type interface.

Rear hinge element 42 is pivotably movable with respect to the fixed front hinge element 41 in a lateral transverse direction to the longitudinal axis LA. The rear hinge element 42 is movable between a closed latched position in which the rear hinge element is inline with the barrel 23 (see, e.g. FIGS. 9A and 13), and an open locked position in which the rear hinge element is laterally displaced and offset from the barrel 23, and now laterally adjacent to the front hinge element 41 as well (see, e.g. FIGS. 9B and 14). In the closed position, the buttstock 30 is axially aligned with the receiver and barrel, and extends in a rearward direction from hinge assembly 40 along the longitudinal axis LA defining a ready-to-fire unfolded length of the firearm. In the open position, the buttstock 30 extends in a forward direction from the hinge assembly 40 defining a stored folded length which is shorter than the unfolded length for compact transport or storage.

It should be noted that the buffer tube in an AR-15 type rifle typically contains the recoil spring. However, the AR-15 style buttstock with buffer tube mounting system may nonetheless be used in other type rifles such as the exemplary bolt action rifle illustrated herein by using the buttstock mounting system with hinge assembly 40. Such rifles may not utilize the buffer tube for the recoil spring which may instead be disposed entirely in the receiver. Accordingly, the present buttstock mounting system is not limited in its applicability and use to buffer tube type buttstocks such as used on AR-15 style rifles.

It should further be noted that the rear hinge element 42 of the buttstock hinge assembly 40 may instead be for configured in some embodiments for mounting non-buffer tube type buttstocks. In some arrangements, such buttstocks of various designs and configurations may be securely mounted to the rear hinge element 42 by other means including fasteners, adhesives, welding, interference fits, etc., or optionally being formed an integral unitary structural part of the rear hinge element. Accordingly, the hinge assembly 40 is not limited in this regard.

With continuing reference now to FIGS. 6-12, hinge 50 of hinge assembly 40 is formed by a plurality of spaced apart cantilevered knuckles 51*a*, 51*b* formed alternatingly on the front and rear hinge elements 41, 42. The knuckles extend horizontally outward from the same lateral side of the front and rear hinge elements and have a generally flat plate-like shape. The knuckles 51*a*, 51*b* of each element are interspersed along a pivot axis PA defined by an elongated hinge pin 52 in an alternating manner. The knuckles 51*a*, 51*b* each include a hole 53 which are all concentrically aligned to accept the hinge pin, thereby pivotably coupling the front and rear hinge elements 41, 42 together. The pin 52 (and pivot axis PA) is vertically oriented and aligned transversely to longitudinal axis LA of the firearm. The hinge pin is arranged to be laterally offset on one side of the receiver 21 or the other so that the buttstock 30 folds sideways about the pivot axis PA when in the folded position. In the illustrated embodiment, the hinge pin 52 is disposed on the left side of the receiver 21 (when viewed looking from the rear of the firearm looking forward) to avoid interference with the bolt handle 25*a*.

Any suitable number of knuckles 51*a*, 51*b* may be provided. In one embodiment, four knuckles 51*a* may be disposed on front hinge element 41 of the hinge assembly 40 and three knuckles 51*b* may be disposed on rear hinge element 42 of the hinge assembly. The knuckles 51*a*, 51*b* in a preferred embodiment may be integrally formed with the front and rear hinge elements as a unitary structural part thereof, or alternatively may be separate parts rigidly and permanently attached to the elements.

To retain the hinge pin 52 within the hinge knuckles 51*a*, 51*b* of the hinge 50, one or more circumferential grooves 54 may be formed in the pin shaft, which each engages a washer 55 disposed between some of the knuckles so that the hole(s) in the washer is/are concentrically aligned with the holes 53 in the knuckles. In one embodiment, a pair of washers and circumferential grooves 54 is provided. The grooves are spaced apart along the shaft of the hinge pin 52. One washer 55 may be disposed between the upper-most knuckle 51*a* of the front hinge element 41 of hinge assembly 40 and adjacent upper-most knuckle 51*b* of the rear hinge element 42, thereby trapping the washer between the knuckles when the hinge is assembled. Similarly, another washer may be disposed between the lower-most knuckles 51*a*, 51*b* of the front and rear hinge elements 41, 42 to the same effect. In one embodiment, a shallow circular recessed seat 56 may be formed around holes 53 in the upper-most and lower-most knuckles 51*b* of the rear hinge element 42 for locating the washers and minimize any additional height to the hinge that might be added by the washers between the hinge knuckles.

The front and rear hinge elements 41, 42 of the buttstock hinge assembly 40 may be made of polymer, metal, composites, or a combination thereof in some non-limiting examples. In one embodiment, the hinge pin 52 is formed of metal (e.g. aluminum, steel, titanium, etc.) and the washers are formed of a polymer or composite material to engage and retain the hinge pin and reduce potential motion or slippage.

Referring to FIGS. 6-12, the buttstock hinge assembly 40 further includes latching and locking mechanisms for latching the buttstock 30 in the unfolded position (see, e.g. FIG. 13) and locking the buttstock in the folded position (see, e.g. FIG. 14), respectively. The latching mechanism includes a transversely mounted cross pin such as cylindrical latch pin 60 comprising an operating end 61 coupled to a latch member such as a latch 80, and an opposing enlarged working end 62 coupled to a lock member such as a release button 63. The latch pin 60 is inserted in a laterally extending transverse passage 70 extending completely through the rear end 42 of the hinge assembly 40 from lateral side to side. The passage 70 may be circular in cross section in one embodiment. Latch pin 60 is both slidably and rotatably moveable in the passageway 70 by a corresponding motion of the release button 63 or latch 80, respectively.

Figure 8A:
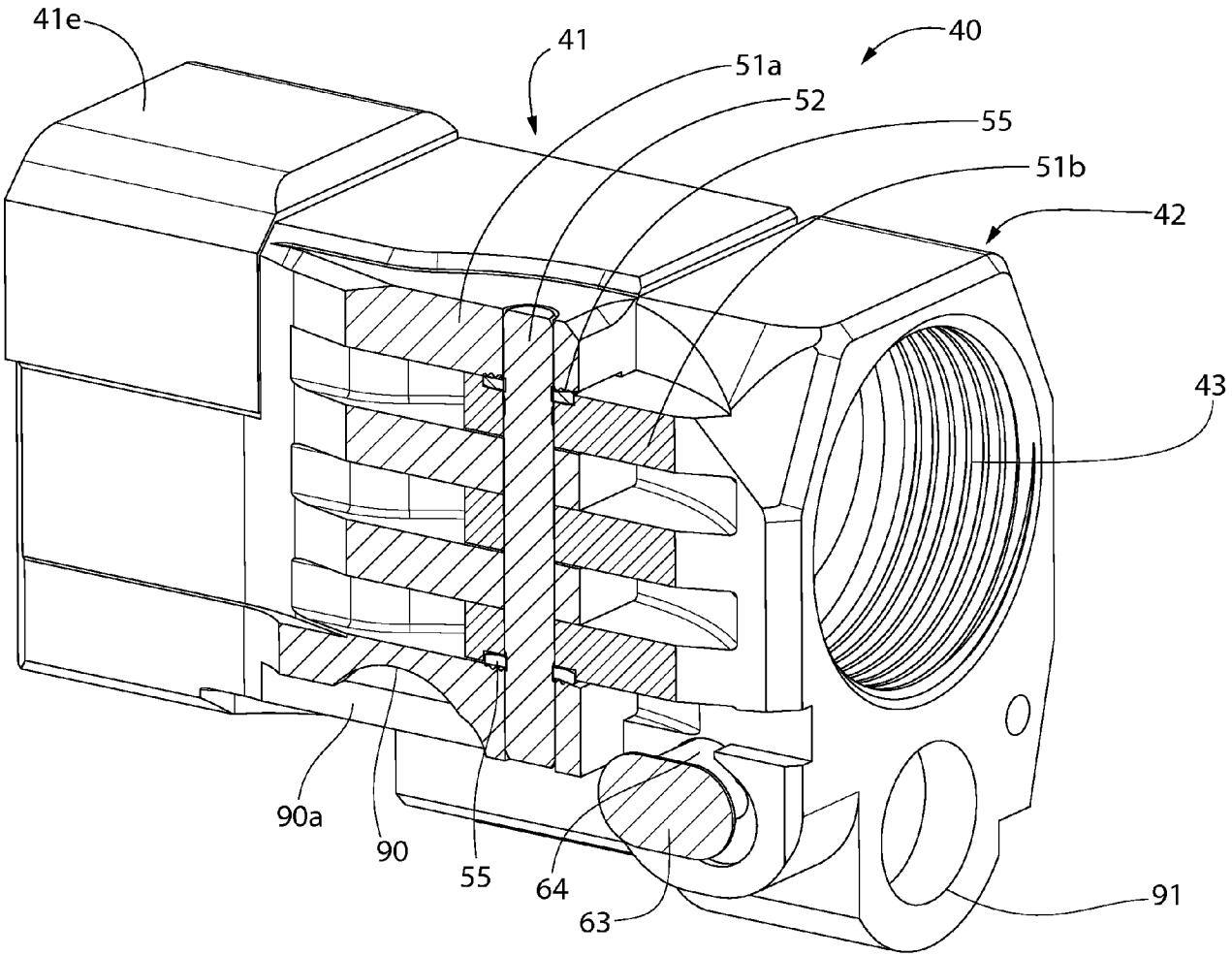
FIG. 8A is a partial left side cross-sectional perspective view of the hinge assembly showing details of the front and rear hinge elements and lock recess.
Figure 8B:
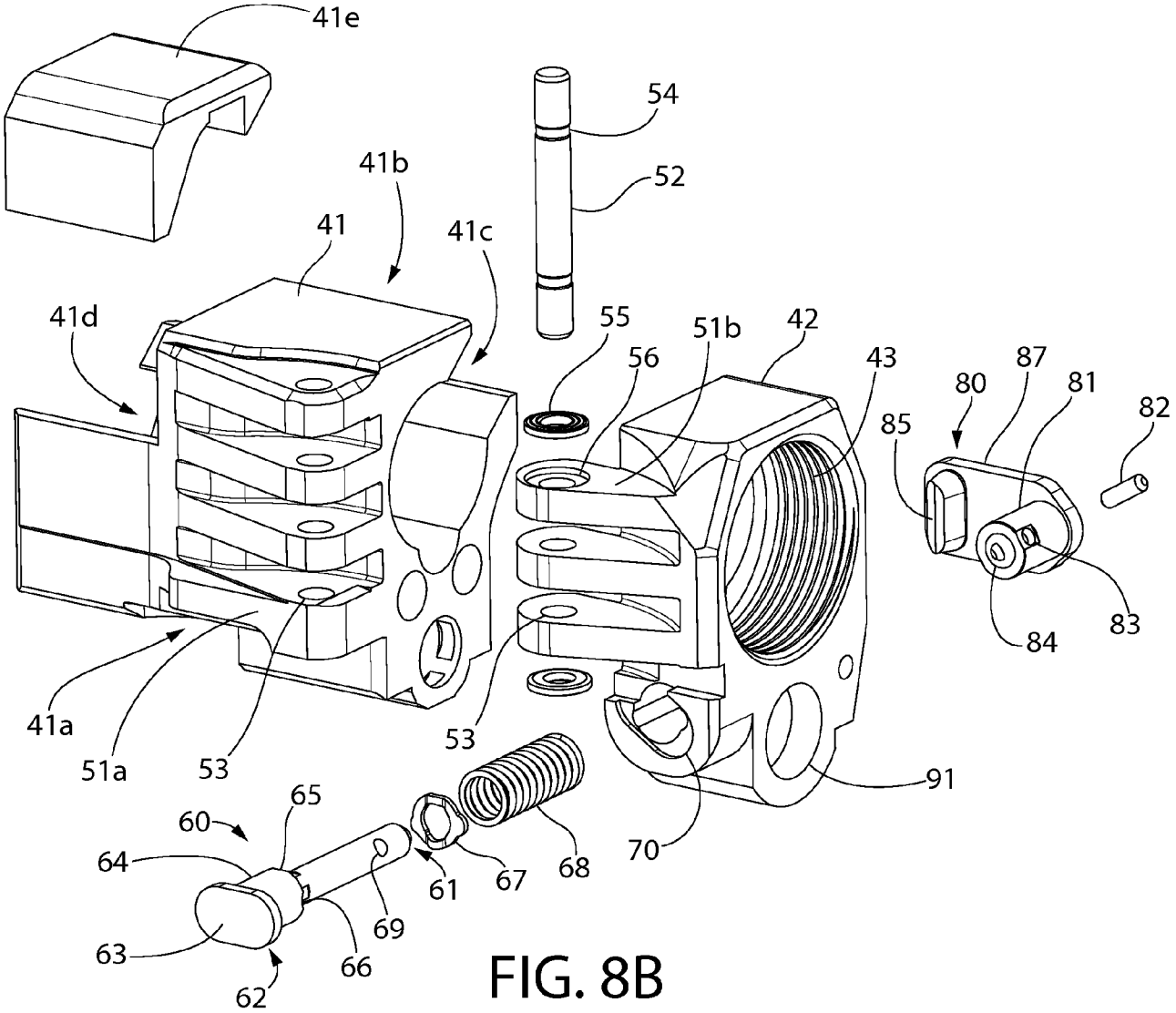
FIG. 8B is an exploded perspective view of the hinge assembly.
Figure 8C:
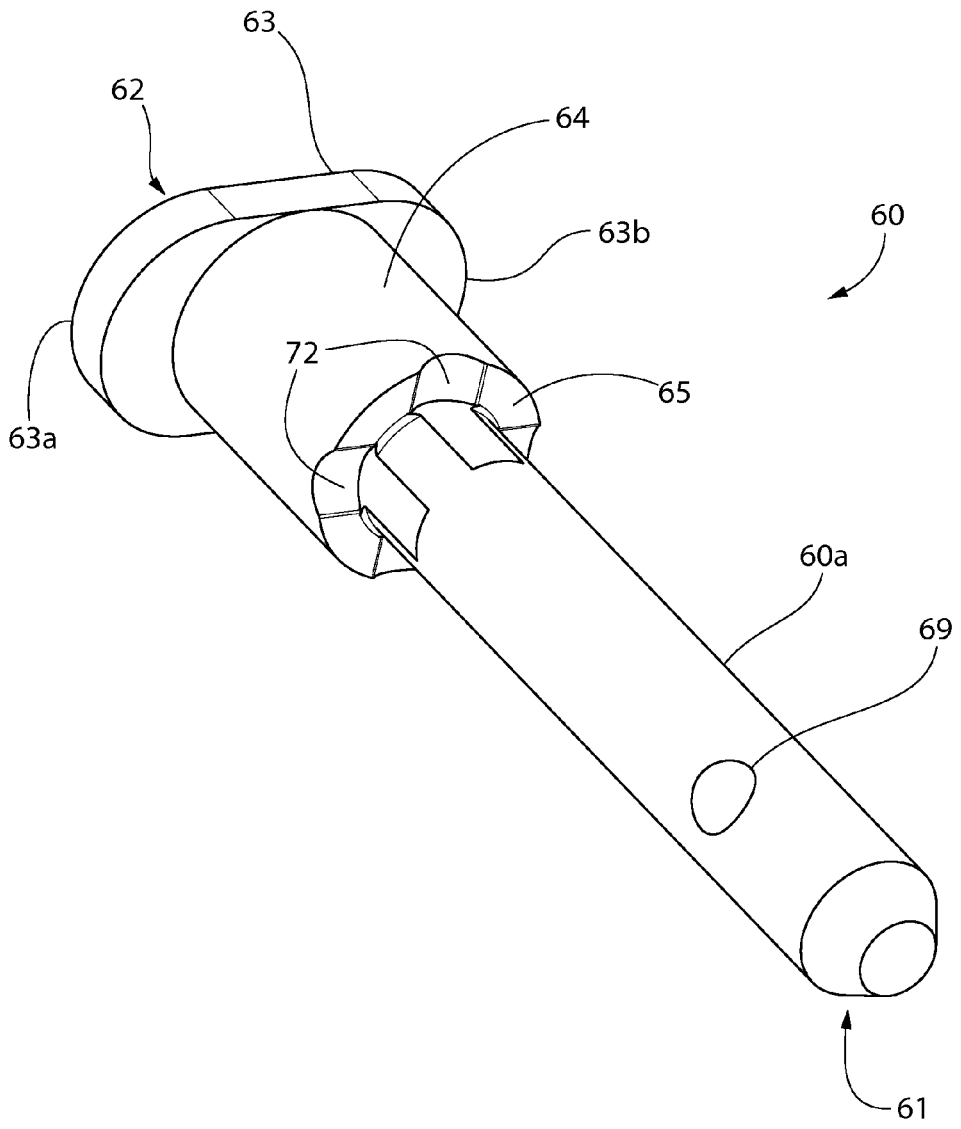
FIG. 8C is a perspective view of the latch pin.

The release button 63 is elongated in shape in a direction transverse to the shaft of the latch pin 60 (see, e.g. FIGS. 8B and 8C). Release button 63 extends outwards from latch pin 60 in two diametrically opposed radial directions as shown, for reasons which will become apparent. Accordingly release button 63 may have a symmetrical shape in some embodiments with respect to the latch pin 60. In one embodiment, the release button 63 has an oblong configuration such as without limitation an elliptical shape having a major and minor axis or radius, oval shape, a rectangular shape as illustrated herein having arcuately rounded ends, or other.

Release button 63 defines a first locking element 63*a* projecting radially outwards on one side from the working end 62 of latch pin 60 and an opposing second locking 63*b* projecting radially outwards on the opposite second side of the pin. The locking elements may be in the form of ears or flanges. One or the other of locking element 63*a* or 63*b* is selectively and rotatably engageable with a downwardly open pocket or lock recess 90 formed on the left lateral side 41*a* of fixed front hinge element 41 of the hinge assembly 40 for locking the buttstock 30 in the folded position (see, e.g. FIG. 14), thereby defining the locking mechanism for maintaining the buttstock 30 in the folded position. In an alternative embodiment, a single locking element 63*a* or 63*b* may be provided which retains the same functionality. However, the dual ears allow the latch 80 on the opposite end of latch pin 60 to be rotated in either direction to rotate and unlock the release button 63 from the lock recess 90.

Figure 9A:
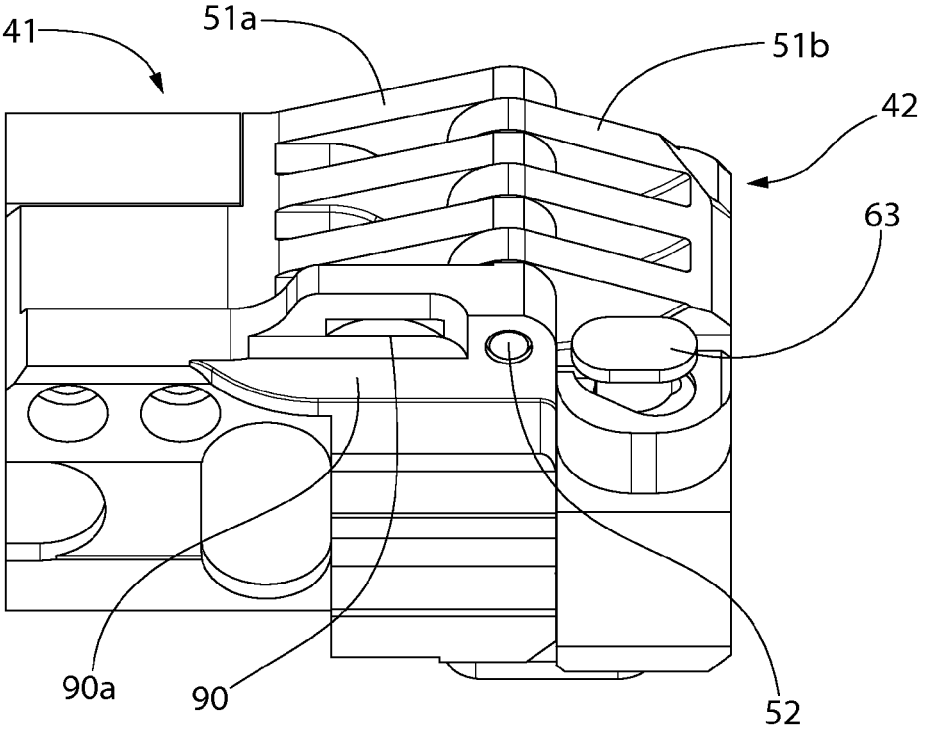
FIG. 9A is a bottom left side perspective view of the closed hinge assembly.
Figure 9B:
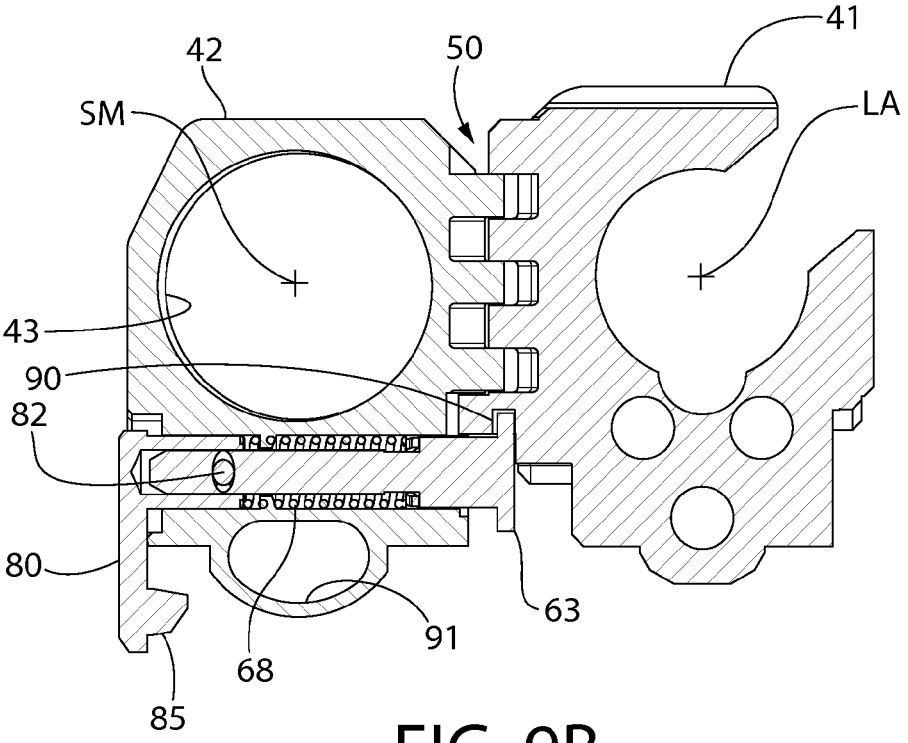
FIG. 9B is a cross-sectional rear end view of the open hinge assembly showing the rear hinge element in a folded fully open position locked to the front hinge element.
Figure 11A:
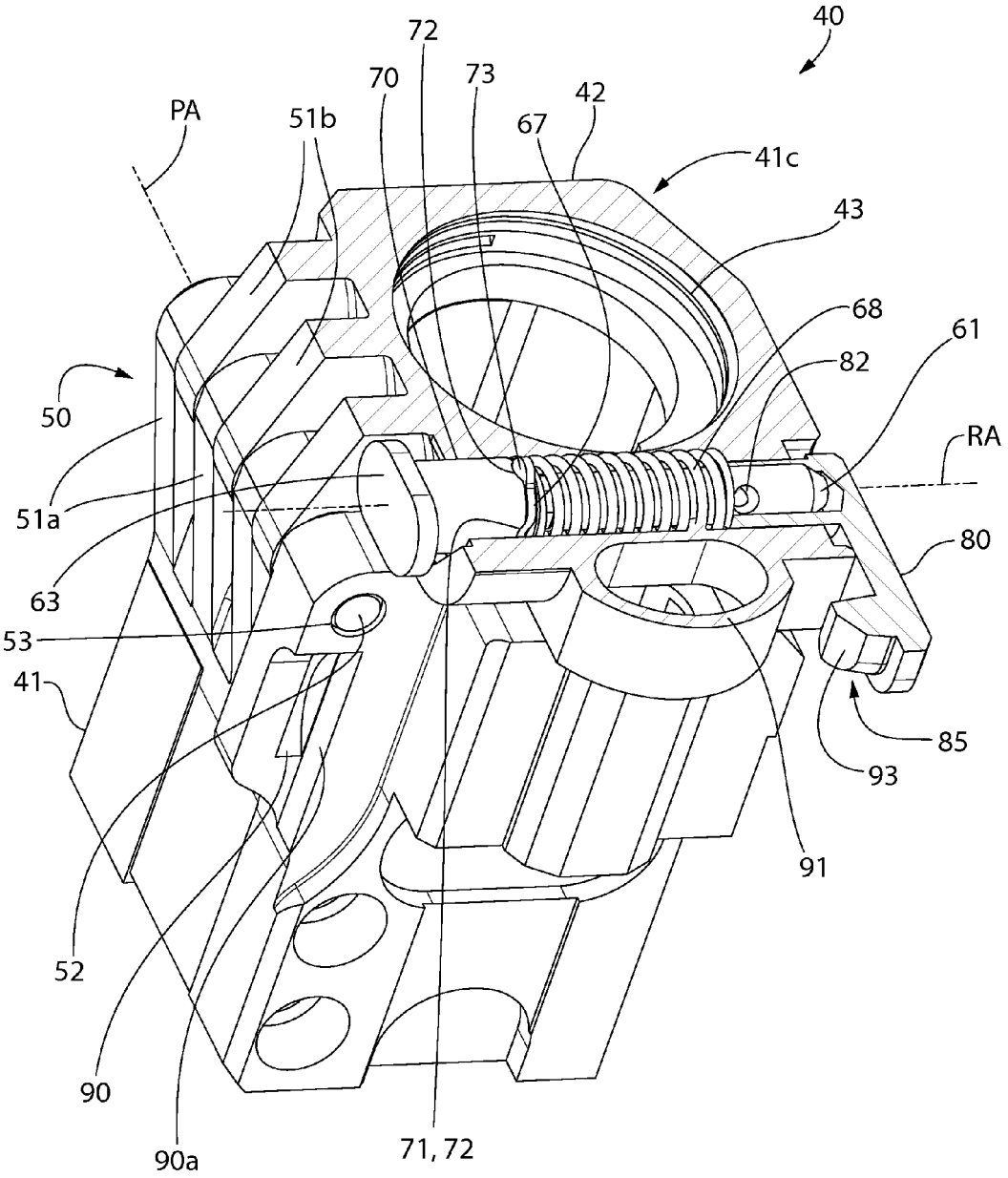
FIG. 11A is a bottom left side perspective view of the hinge assembly in a closed position showing the rear hinge element in transverse cross section to reveal the latch pin assembly.
Figure 11B:
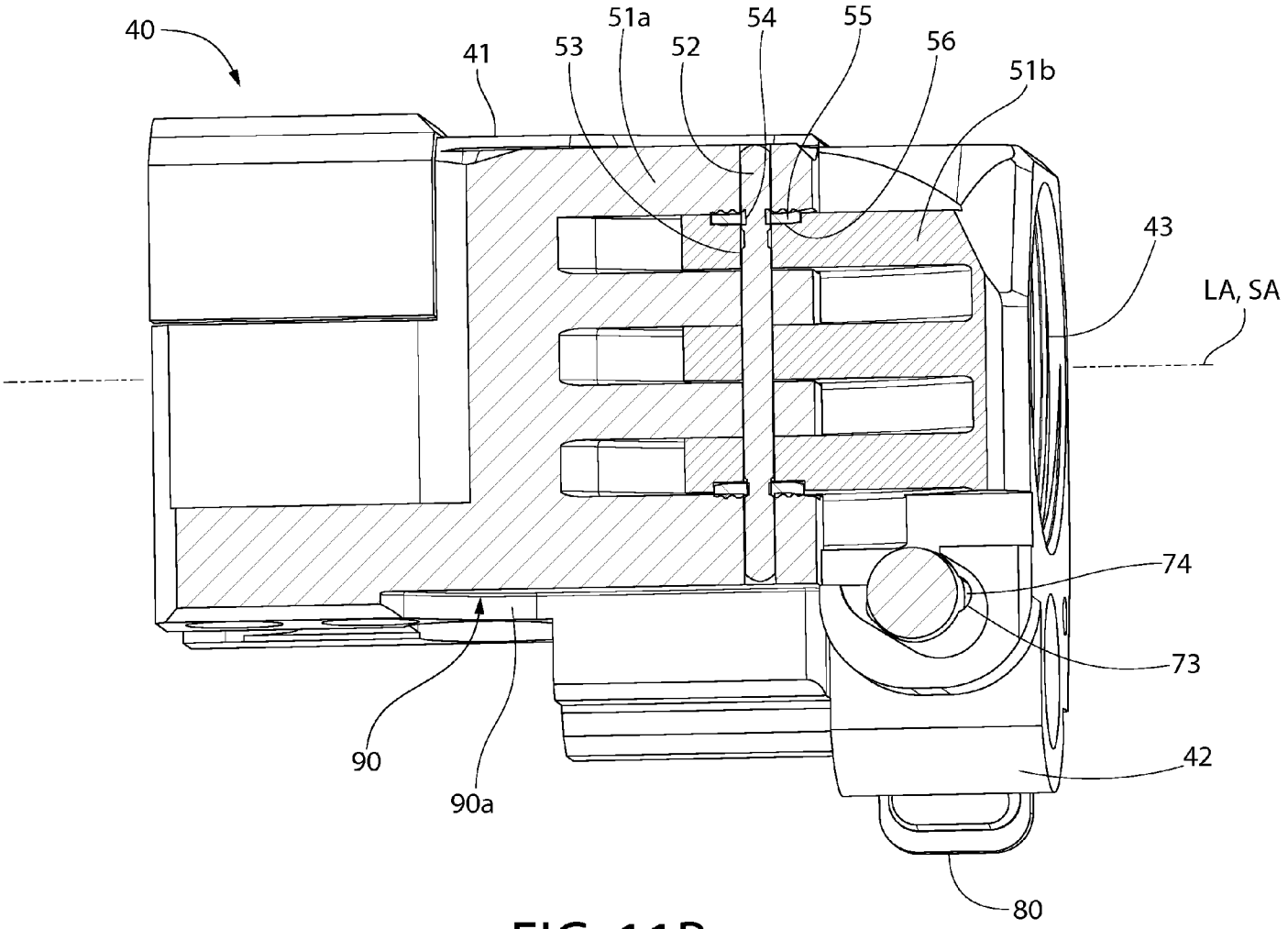
FIG. 11B is a partial cross-sectional perspective view of the left side of the hinge assembly showing details of the hinge pin assembly.
Figure 11C:
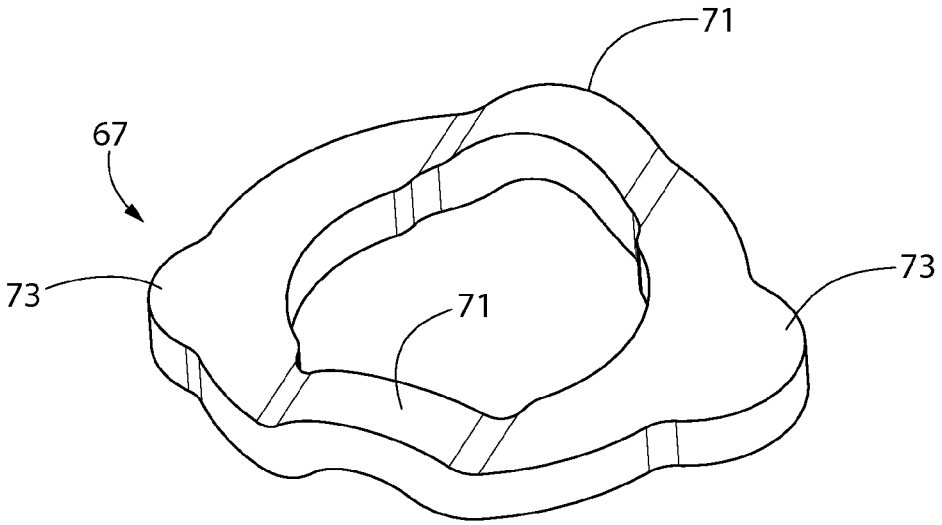
FIG. 11C is a perspective view of a detent washer of the latch mechanism.
Figure 11D:
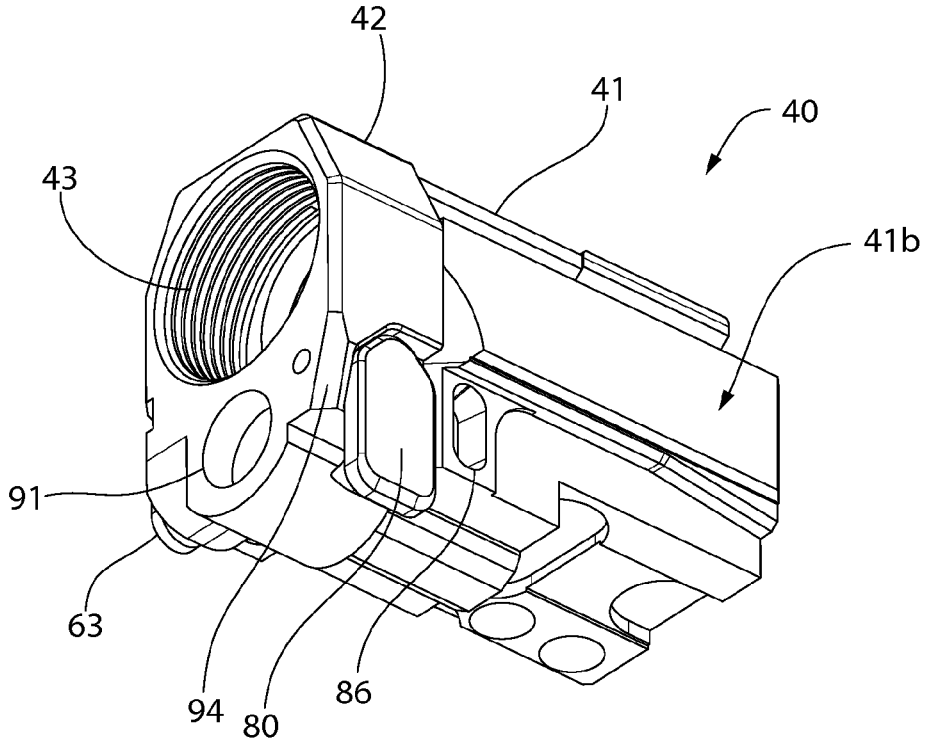
FIG. 11D is a rear right side perspective view of the closed hinge assembly showing the latch member in a vertical orientation and the latch recess on the front hinge element.
Figure 12:
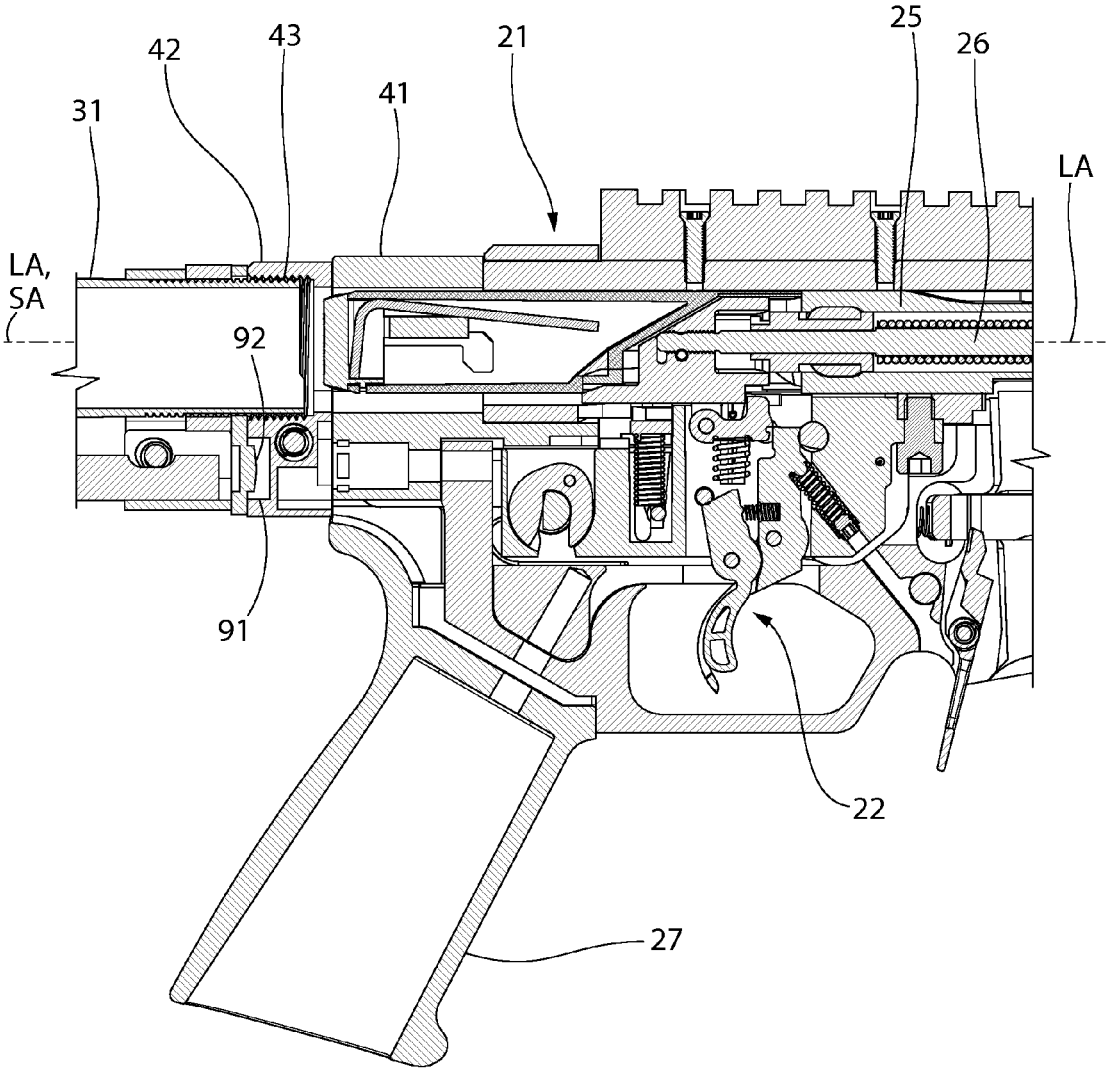
FIG. 12 is a right side partial cross sectional view of the receiver, hinge assembly, and front portion of the buttstock showing buttstock mounting details.

In one embodiment, the lock recess 90 may be formed as an undercut in the left lateral side 41*a* of the front hinge element 41, and in a preferred embodiment is formed in the lower-most knuckle 51*a* of hinge assembly 40 (see particularly FIGS. 8A, 9A, and 11A). FIG. 8A shows a partial cross section through lock recess 90 which in the present non-limiting embodiment may be arcuately shaped as illustrated. This allows the release button 63 with arcuately rounded ends to be rotated smoothly while positioned within the recess 90 as further described herein. Other configurations of lock recess 90 may be provided depending in part on the configuration of release button 63 which is received in the recess. In yet other configurations contemplated, the lock recess 90 may instead be upwardly open and operate in the same manner. Lock recess 90 has a depth to allow one of the locking elements 63*a* or 63*b* of latch pin 60 to be inserted deep enough to positively lock and secure the buttstock 30 in the folded position.

With reference now to FIGS. 6-12, the operating end 61 of latch pin 60 is configured and dimensioned for insertion into a circular socket 84 formed in a tubular mounting collar 81 on the latch 80. Collar 81 projects perpendicular to and inwards from one end of latch body 87 when the latch is assembled to the hinge assembly 40. In one embodiment, the end surfaces of the operating end 61 and closed end of collar 81 at the bottom of the socket 84 may each have mating complementary configured tapers to provide a wedging action for forming a secure frictional fit (see, e.g. FIGS. 8C and 11A). To further rotationally lock the latch 80 to the latch pin 60 as an added measure, a through hole 69 may be provided formed proximate to the operating end 61 of the latch pin which is concentrically alignable with a pair of radially spaced part through holes 83 formed through the sidewalls of the tubular collar 81 on opposing sides of the socket 84. The through holes 83 communicate with the socket 84 so that a set pin 82 may be inserted through the holes 83 and hole 69 in the latch pin 60, thereby rotationally locking the latch 80 to the latch pin and eliminating relative movement between the two parts. Accordingly, rotating the latch 80 will concomitantly rotate the latch pin 60. In one embodiment, the latch 80 is mounted to the latch pin 60 so that the direction of elongation (i.e. the lengths) of the latch and release button 63 are oriented the same (see, e.g. FIG. 11A) for reasons which will become evident.

Latch 80 may have an elongated flat body 87 having a generally rectangular shape. The latch body has a greater length than width (see, e.g. FIGS. 8B and 11A). The latch 80 may be made of any suitable material including polymers, metal, or a combination thereof.

The latch 80 further includes a latching protrusion 85 for locking the buttstock 30 in the unfolded inline position aligned with the barrel 23 of the firearm 20. In one embodiment, latching 85 may be in the form of a hook element which projects inwardly from the body 87 of the latch towards the longitudinal axis LA when the buttstock is in the unfolded inline position. Latching protrusion 85 is disposed on an opposite end of the latch body 87 from the tubular mounting collar 81 on the remaining end. The latching protrusion 85 is selectively engageable with a complementary configured latch recess 86 formed in the lateral side of the front hinge element 41 of the hinge assembly 40 opposite the lateral side where the hinge 50 is located. Latch recess 86 is laterally and outwardly open and may comprise an angled or tapered surface 86*a* which engages a mating tapered surface 85*a* on the latching protrusion 85 when the hinge assembly 40 is in the closed position.

Figure 7B:
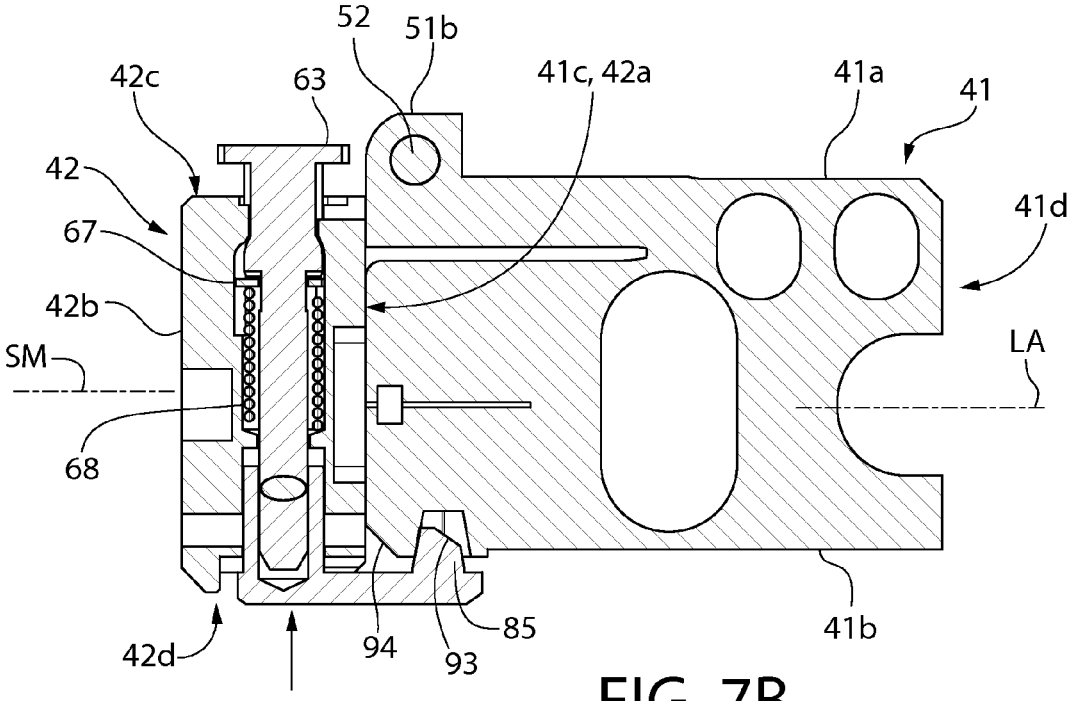
FIG. 7B is a cross-sectional top view thereof showing the rear hinge element in a partially rotated unlatched position.
Figure 10A:
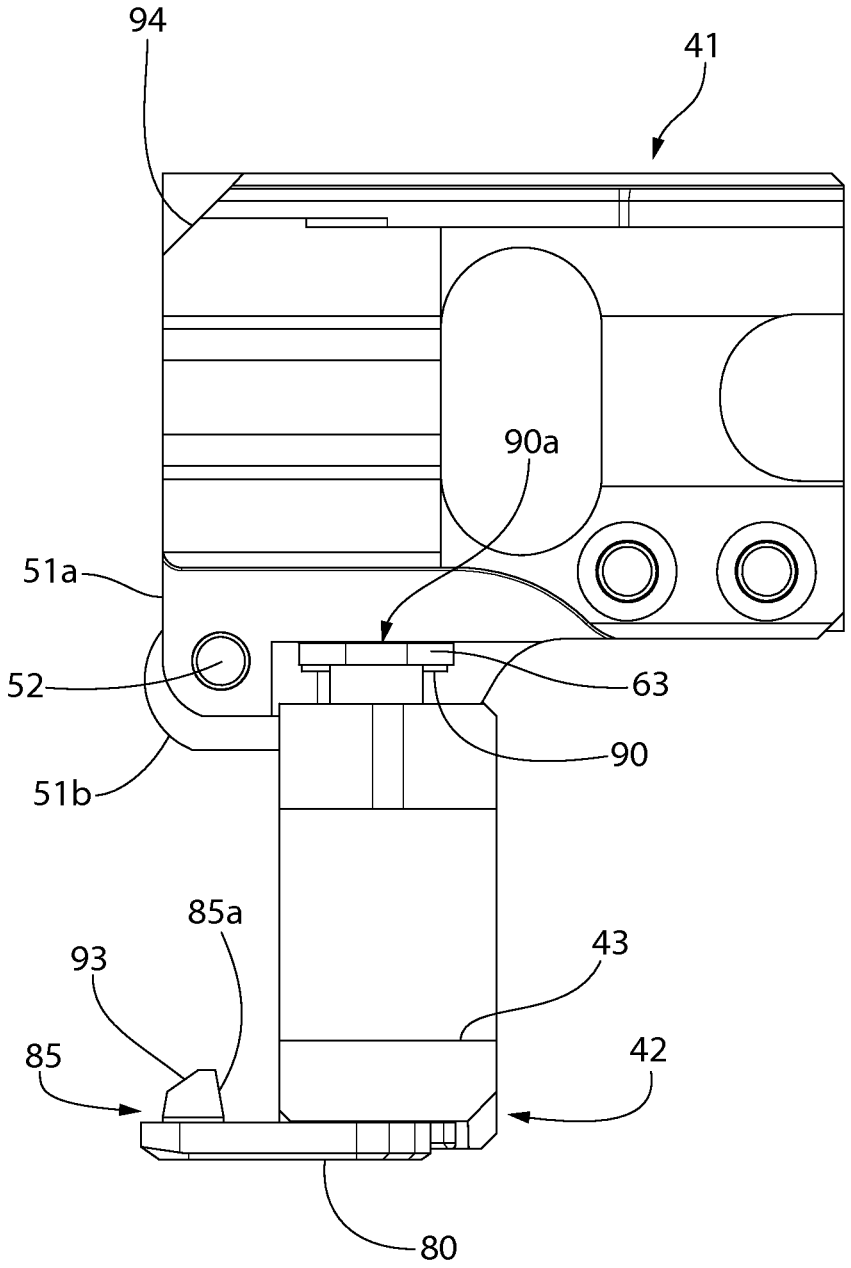
FIG. 10A is a bottom view of the hinge assembly showing the rear hinge element in a laterally offset and folded fully open position with the lockable release button positioned below a lock recess in the front hinge element.
Figure 10C:
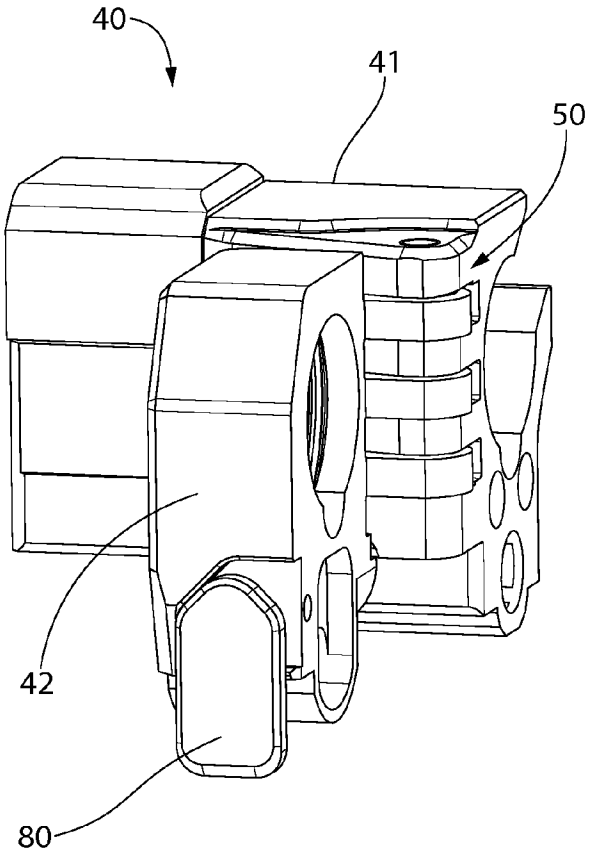
FIG. 10C is the same perspective view thereof showing the latch member in a vertical position corresponding to the rear hinge locked to the front hinge element and in the folded fully open position.
Figure 10B:
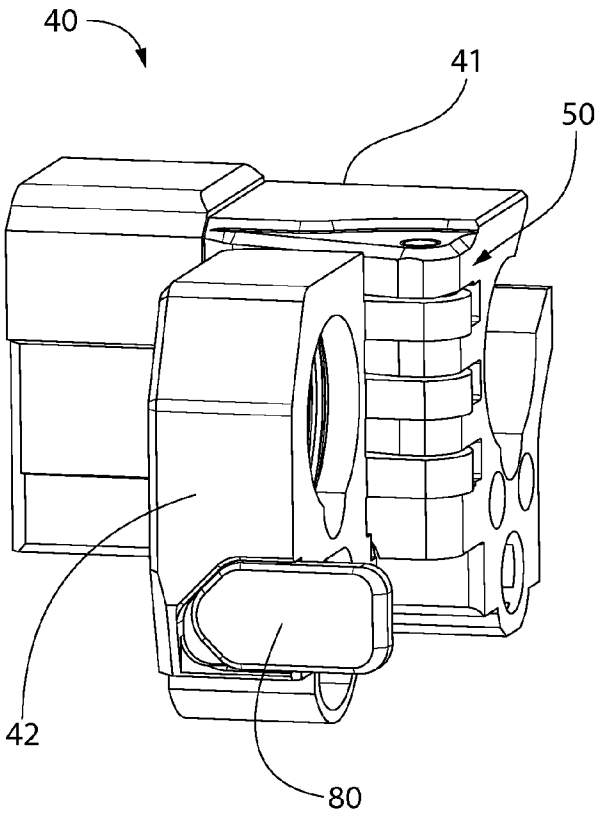
FIG. 10B is a left side perspective view of the hinge assembly showing the latch member in a horizontal position corresponding to the rear hinge element unlocked from the front hinge element and in the folded fully open position.

When the latch pin 60 and latch 80 assembly is mounted to the rear hinge element 42 of hinge assembly 40, the latch is selectively rotatable between a "latched" position in which the latching protrusion 85 engages the latch recess 86 on the front hinge element 41 of the buttstock hinge assembly 40 (see, e.g. FIGS. 7B and 10B, and an "unlatched" position in which the latching protrusion disengages the latch recess (see, e.g. FIGS. 7A and 10C). As shown in the foregoing figures, the latch body 87 is in a substantially horizontal orientation when the latch 80 is in the latched position and a substantially vertical position when the latch is in the unlatched position.

A spring 68 is provided which biases the latch 80 inwards to ensure that the latching protrusion 85 remains positively engaged with the latch recess 86 when the buttstock is in the unfolded inline position with barrel 23. Spring 68 may be a compression spring mounted on the latch pin 60 having a first end engaged with the mounting collar 81 of the latch 80 and an opposite second end. In some embodiments, the second end of the spring may engage a shoulder 65 formed between the diametrically smaller main portion 60*a* of the latch pin 60 shaft and a diametrically larger end portion 64 formed adjacent the enlarged release button 63. In yet other embodiments as illustrated, a detent mechanism may be provided which is engaged by the second end of the spring that helps retain the latch 80 in the latched and unlatched position.

Referring to FIGS. 7, 8B, 8C, 11A, 11B, and 11C, the detent mechanism may comprise a detent washer 67 fitted onto the smaller main portion of the latch pin 60 shaft. The washer 67 is forced into engagement with the shoulder 65 on latch pin 60 by the second end of the spring 68. A pair of diametrically opposed detents in the form of raised ridges 71 engage complementary configured notches 72 formed on the shoulder 65 when the latch 80 is in either of the "latched" or "unlatched" positions. In one embodiment four notches 72 spaced 90 degrees apart along the circumference of the shoulder are provided; one diametrically opposed pair of notches associated with the latched position of the latch 80 and the other diametrically opposed pair of notches associated with the unlatched position (best shown in FIG. 8C). A pair of diametrically opposed ears 73 protruding outwards from the washer 67 engages mating grooves 74 in the rear hinge element 42 of the hinge assembly 40 adjoining the through passageway 70 to maintain the washer in a fixed orientation. This keeps the raised ridges 71 in the same orientation to alternatingly engage either the pair of "latched" notches or "unlatched" notches which alternate and rotate with the latch 80 and rotation of the latch pin 60.

Figure 13:
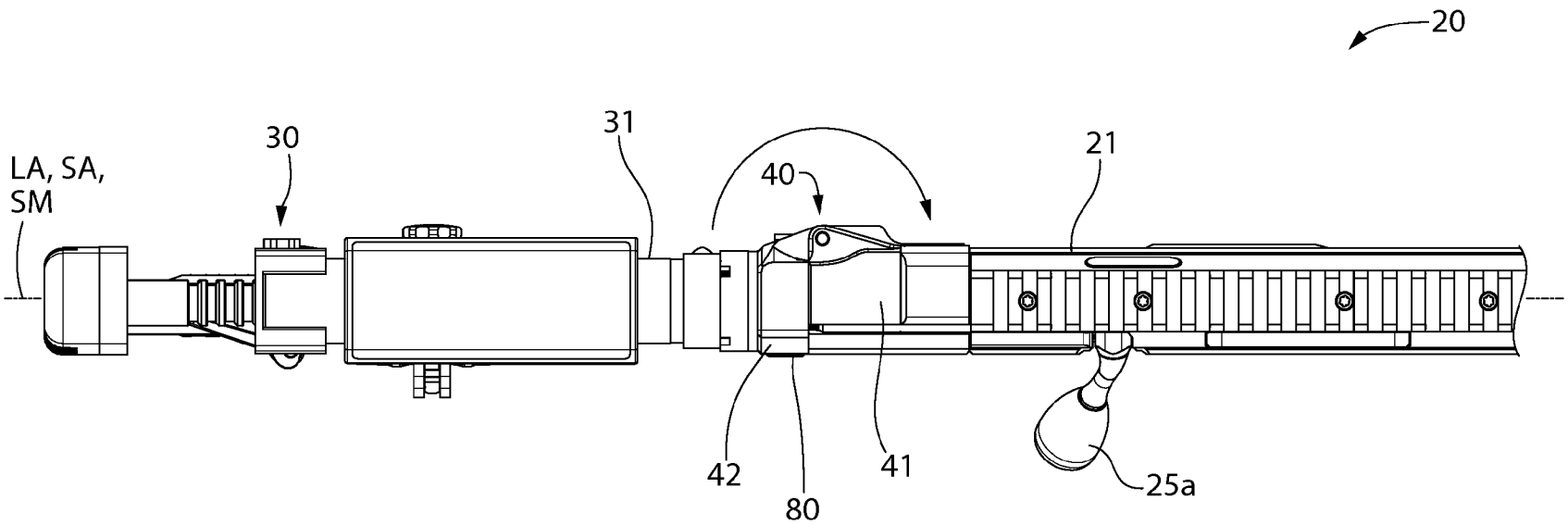
FIG. 13 is a top view of the rear portion of the firearm showing the buttstock in an inline unfolded and latched position.
Figure 14:
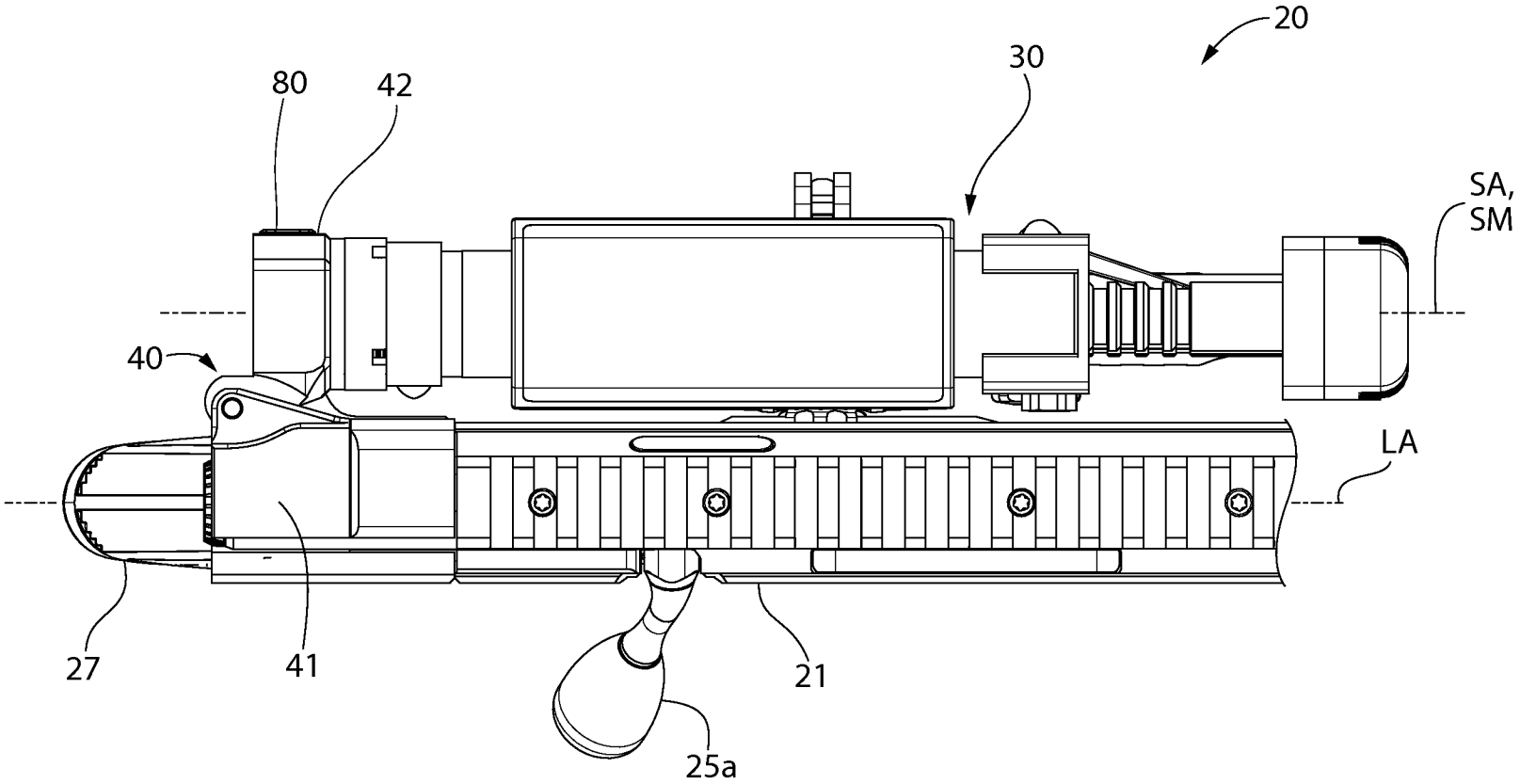
FIG. 14 is a top view of the rear portion of the firearm showing the buttstock in an offset folded and locked position.

Operation of the latching and locking operation of the foldable buttstock 30 will now be briefly described. Referring to FIG. 13, the process starts with the buttstock 30 initially in the unfolded inline position with the barrel 23. The latch 80 is in the latched position shown in FIGS. 6A and 7B in which the latch body 87 is horizontally oriented and the buttstock hinge assembly 40 is closed as shown. The latching protrusion 85 is engaged with the latch recess 86 to latch the buttstock in the unfolded and ready-to-fire position.

Beginning the process of unlatching and folding the buttstock 30, latch 80 must first be disengaged from the latch recess 86. To accomplish this, the user pushes inwards on the release button 63 of the latch pin 60 on the left side of the firearm opposite the latch 80 which is on the right side. It bears noting that head 63 is therefore enlarged not only for purposes to function as a lock for the buttstock, but further for push button operation. The latch pin 60 moves laterally left to right against the biasing force of latch spring 68 as the pin slides in transverse passage 70. This action forces the latch 80 outwards away from the receiver to disengage the latching protrusion 85 from the latch recess 86. The user then pivots the buttstock 30 towards the left while initially holding the release button 63 inwards. When the latch 80 is disengaged from and clears the front hinge element 41, the user may release the release button 63 because the latching protrusion 85 is no longer laterally aligned with the latch release. Therefore, the buttstock 30 remains unlatched allowing it to be freely pivoted and folded. The latch 80 remains in the horizontal position as concomitantly does the release button 63. The unlatching process is complete.

To fold and lock the buttstock 30, the buttstock (concomitantly with hinge assembly 40) is rotated by the user approximately 180 degrees from the right to left lateral side of the hinge assembly and firearm 20. The release button 63 still in the horizontal position (together with the latch 80) first contacts an abutment surface 90*a* immediately beneath the lock recess 90 on the left lateral side 41*a* of the hinge assembly, thereby pushing or lifting the latch 40 outwards against the force of spring 68. Surface 90*a* is preferably flat as is the mating exposed outward surface of the release button 63. The compression spring 68 that normally pushes the release button 63 outwards away from the rear hinge element 42 of the hinge assembly acts to dampen the contact as the buttstock is pivoted to the folded position. The spring force also automatically maintains the horizontal orientation of the release button 63 against the abutment surface 90*a* to ensure that the underside of the head is in the proper position to be rotated and engage the lock recess 90 in the front hinge element 41 body. In the horizontal position, the long sides of the release button 63 can clear the lower-most knuckle 51*a* of the front hinge element 41 to access the lock recess 90 above. This mechanism does not require the user to manually manipulate the release button 63 or latch 80. This position of latch 80 is shown in FIG. 10B showing the rear hinge element 42 in the fully open position folded against the front hinge element 41.

The rectangular latch 80 now becomes an elongated lever used to conveniently rotate the release button 63 on the latch pin 60 into the locked position. With the buttstock 30 in the fully folded 180 degree position, the user rotates the latch 80 downwards 90 degrees to the vertical position, as shown now in FIG. 10C. The release button 63 on the opposite end of the latch pin 60 (now inaccessible being trapped between the front and rear hinge elements) rotates from the horizontal to the vertical position with the latch motion. This engages one or the other of the locking elements 63*a* or 63*b* on the short sides of the release button 63 with the lock recess 90, thereby locking the buttstock 30 in the folded position. Advantageously, the latch spring 68 in the present position when the latch 80 is released by the user now biases and pushes the latch pin 60 and concomitantly buttstock 30 in a laterally outward direction to keep the release button 63 firmly engaged in the lock recess 90 when the buttstock is folded. This tries to force the buttstock to pivot, but it cannot because of the engagement of the release button 63 with the lock recess 90 which keeps the buttstock in the fully folded position.

In order to move the buttstock 30 back to the inline unfolded position, the latch 80 is switched back to the horizontal position. This removes the locking element 63*a* or 63*b* from lock recess 90 by rotating the release button 63 back to its horizontal position (see, e.g. FIG. 10B). The buttstock is now free to pivot. The user has the option to engage the lock when desired, or leave it unlocked without having it accidently catch and lock in the folded position.

The buttstock 30 is returned to its unfolded inline position by pivoting the buttstock from left to right back towards longitudinal axis LA with the latch 80 remaining in the horizontal position. In one embodiment referring to FIGS. 7A and 7B (note also directional motion arrows shown), a chamfered surface 93 which may be provided on the latching protrusion 85 engages a mating chamfered surface 94 on the rear right corner of the front hinge element 41(see also FIGS. 11A and 11D). This slightly pushes the latch 80 and latch pin 60 outwards from the rear hinge element 42 as shown against the inward biasing force of latch spring 68, thereby allowing the latching protrusion 85 to ride over the front hinge element 41 to re-engage latch recess 86 (see, e.g. FIG. 7B). The buttstock 30 is now in the fully unfolded and inline position wherein the firearm 20 is in the ready-to-fire format. By using the mating chamfered surfaces 93 and 94, the buttstock is automatically re-latched by the pivoting action of the buttstock without the user having to manually manipulate the position of latch 80 by pushing the release button 63 inwards if the chamfered surfaces are not provided. In less preferred but satisfactory embodiments, the chamfered surfaces may be omitted.

It is significant to note that although the latch pin 60 and corresponding latching/locking mechanism formed by latch 80 and release button 63 are illustrated in one non-limiting configuration herein as being incorporated with the movable rear hinge element 42 of the hinge assembly 40, the latching/locking mechanism with latch pin may instead be mounted in the fixed front hinge element 41 attached to the receiver 21. Accordingly, the latch pin and latching/locking mechanism may be configured the same as disclosed herein but may be disposed in the front hinge element 41. In this alternate mounting configuration, the lock recess 90 and latch recess 86 would then instead be provided in opposing lateral sides of the movable rear hinge element 42. Either arrangement of the latch pin and latching/locking mechanism will function properly and may be used at the discretion of the designer. Accordingly, the invention is expressly not limited to locating the latching/locking mechanism in either the fixed or movable elements of the hinge assembly.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with folding buttstock comprising:

a receiver;

a barrel coupled to a front end of the receiver, the barrel defining a longitudinal axis and an axially extending bore forming a projectile pathway;

an elongated buttstock defining a stock axis;

a hinge assembly pivotably coupling the buttstock to the receiver, the hinge assembly comprising a fixed front hinge element coupled to the receiver, a movable rear hinge element coupled to the buttstock, and a hinge pivotably coupling the front and rear hinge elements together;

the buttstock pivotably movable between an inline position, and an offset position in which the stock axis is laterally offset from the longitudinal axis;

a latch pin rotatably and slideably carried transversely by the hinge assembly;

a latching mechanism on a first lateral side of the hinge assembly comprising a latch member on a first end of the latch pin engageable with a latch recess on the first lateral side, the latching mechanism operable to maintain the buttstock in the inline position when the latch member engages the latch recess;

a locking mechanism on a second lateral side of the hinge assembly comprising a lock member on a second end of the latch pin engaging a lock recess on the second lateral side, the locking member operable to maintain the buttstock in the offset position when the lock member engages the lock recess; and a latch spring biasing the latch member in an inward direction and the lock member in an outward direction with respect to the hinge assembly;

wherein rotating the latch member in opposing directions selectively engages the lock member with or disengages the lock member from the lock recess when the buttstock is in the offset position.

2. The firearm according to claim 1, wherein buttstock is not movable from the offset position when the lock member engages the lock recess.

3. The firearm according to claim 1, wherein the latch spring is a compression spring mounted on the latch pin.

4. The firearm according to claim 1, wherein pushing the lock member in an inwards direction towards the hinge assembly projects the latch member outwards from the rear hinge element to disengage the latch member from the latch recess when the buttstock is in the inline position.

5. The firearm according to claim 1, further comprising a detent mechanism comprising:

a first pair of diametrically opposed notches formed on the hinge pin;

a second pair of diametrically opposed notches formed on the hinge pin; and a pair of diametrically opposed raised ridges formed on a washer engaged by one end of the latch spring;

wherein rotating the latch member in a first direction selectively engages the pair of raised ridges with the first pair of notches when the latch member is in a horizontal orientation, and rotating the latch member in an opposite second direction selectively engages the pair of raised ridges with the second pair of notches when the latch member is in a vertical orientation.

6. The firearm according to claim 5, wherein the first and second pairs of notches are formed on a diametrically enlarged shoulder disposed on the latch pin.

7. The firearm according to claim 1, wherein the lock recess is downwardly open.

8. The firearm according to claim 1, wherein the latch recess is laterally open.

9. The firearm according to claim 8, wherein the latch recess includes a tapered surface that engages a mating tapered surface on the latch member when the buttstock is in the inline position.

10. The firearm according to claim 1, wherein the latch member includes a latching protrusion extending inwardly from the latch member which engages the latch recess.

11. The firearm according to claim 10, wherein the latching protrusion includes a chamfered surface which engages a mating chamfered surface on the hinge assembly when the buttstock is moved from the offset position to the inline position, the engaged chamfered surfaces pushing the latch member outwards from the second hinge element against the biasing force of the latch spring.

12. The firearm according to claim 1, wherein the lock member comprises a release button having an oblong shape oriented transversely to the latch pin which defines a pair of opposing locking elements selectively engageable with the lock recess when the buttstock is in the offset position.

13. The firearm according to claim 1, wherein the hinge assembly includes the hinge pin extending through meshed knuckles formed on the front and rear hinge elements of the hinge assembly, the hinge pin including a pair of space apart circumferential grooves each engaging a washer disposed in the knuckles of the hinge which secures the hinge pin to the knuckles.

14. A self-locking pivotable buttstock hinge assembly for a firearm having a receiver and a buttstock, the hinge assembly comprising:

a front hinge element configured for attachment to the receiver of the firearm, the front hinge element defining a longitudinal axis and comprising a first lateral side, a second lateral side and a plurality of knuckles each including a through hole collectively defining a pivot axis;

a rear hinge element comprising a first lateral side, a second lateral side, a plurality of knuckles pivotably connected to the knuckles of the first element by a hinge pin, the rear hinge element movable between a closed position and an open position, the rear hinge element defining a mounting flange configured for attachment of the buttstock;

a latch pin extending through a transverse passage formed between the first and second lateral sides of one of the front or rear hinge element, the latch pin being slidable and rotatable in the passage;

a latch recess formed in the first lateral side of the front or rear hinge element which does not have the latch pin;

a lock recess formed in the second lateral side of the front or rear hinge element which does not have the latch pin;

an elongated latch having an inwardly projecting latching protrusion on one end of the latch pin;

an elongated release button on another end of the latch pin having a locking element; and a latch spring biasing the latch in an inward direction and the release button in an outward direction with respect to the front or rear hinge element which does not have the latch pin;

wherein when the rear hinge element is in the closed position, the latching protrusion engages the latch recess and latches the rear hinge element in the closed position;

wherein when the rear hinge element is in the open position, the locking element is rotatable by rotating the latch to engage the locking element with the lock recess and locks the rear hinge element in the open position.

15. The hinge assembly according to claim 14, wherein the stock mounting axis of the rear hinge element is parallel to but laterally offset from the longitudinal axis of the front hinge element when the rear hinge element is in the open position.

16. The hinge assembly according to claim 14, wherein the release button has an oblong shape oriented transversely to the latch pin which defines a pair of opposing locking elements selectively engageable with the lock recess when the hinge assembly is in the offset position.

17. The firearm according to claim 14, wherein the latching protrusion includes a chamfered surface which engages a mating chamfered surface on the front hinge element when the hinge assembly is moved from the open position to the closed position, the engaged chamfered surfaces pushing the latch member outwards from the second hinge element against the biasing force of the latch spring.

18. The firearm according to claim 14, wherein the latch recess includes a tapered surface that engages a mating tapered surface on the latch when the hinge assembly is in the closed position.

19. A method for operating a folding firearm buttstock, the method comprising:

providing a firearm including a receiver, a barrel supported by the receiver, a buttstock, and a hinge assembly comprising a front hinge element fixedly attached to the receiver, a rear hinge element pivotably attached to the front hinge element, and a spring-biased latch pin carried by the hinge assembly comprising an elongated latch member disposed on a first end of the latch pin and an elongated lock member disposed on a second end of the latch pin, the buttstock attached to the rear hinge element and movable therewith;

placing the latch member in a horizontal orientation;

engaging the latch member with a latch recess on a first lateral side of the hinge assembly, wherein the buttstock is in a latched inline position with respect to the barrel;

disengaging the latch member from the latch recess by pushing the lock member towards the first lateral side of the hinge assembly;

pivoting the buttstock laterally outwards about the hinge assembly in a first direction;

contacting the lock member with a second lateral side of the hinge assembly opposite the first lateral side;

rotating the latch member to a vertical orientation while maintaining contact with the second lateral side of the hinge assembly; and engaging the lock member with a lock recess on the second lateral side of the hinge assembly, wherein the buttstock is in a locked offset position laterally offset from and parallel to the barrel.

20. The method according to claim 19, further comprising:

rotating the latch member back to the horizontal position;

disengaging the lock member from the lock recess;

pivoting the buttstock laterally inward about the hinge assembly in a second direction opposite the first direction; and re-engaging the latch member with the latch recess, wherein the buttstock is in a latched inline position with the barrel.

* * * * *